US010207498B2

(12) United States Patent
Nakano et al.

(10) Patent No.: US 10,207,498 B2
(45) Date of Patent: Feb. 19, 2019

(54) INKJET PRINTING APPARATUS AND CONTROL METHOD

(71) Applicant: CANON KABUSHIKI KAISHA, Tokyo (JP)

(72) Inventors: Takatoshi Nakano, Yokohama (JP); Minoru Teshigawara, Saitama (JP); Atsushi Takahashi, Tama (JP); Takuya Fukasawa, Kawasaki (JP); Rinako Kameshima, Tachikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/623,833

(22) Filed: Jun. 15, 2017

(65) Prior Publication Data

US 2018/0001623 A1 Jan. 4, 2018

(30) Foreign Application Priority Data

Jun. 29, 2016 (JP) ..... 2016-129086
May 10, 2017 (JP) ..... 2017-094289

(51) Int. Cl.

| | |
|---|---|
| ***B41J 2/195*** | (2006.01) |
| ***B41J 2/045*** | (2006.01) |
| ***B41J 2/175*** | (2006.01) |
| ***B41J 2/18*** | (2006.01) |

(52) U.S. Cl.

CPC ..... *B41J 2/0456* (2013.01); *B41J 2/04586* (2013.01); *B41J 2/175* (2013.01); *B41J 2/17566* (2013.01); *B41J 2/18* (2013.01); *B41J 2/195* (2013.01)

(58) Field of Classification Search

CPC . B41J 2/175; B41J 2/17566; B41J 2/18; B41J 2/195

See application file for complete search history.

(56) References Cited

U.S. PATENT DOCUMENTS

| | | | |
|---|---|---|---|
| 6,142,600 | A | 11/2000 | Takahashi et al. |
| 6,561,622 | B1 | 5/2003 | Suzuki et al. |
| 6,984,009 | B2 | 1/2006 | Nakagawa et al. |
| 6,994,416 | B2 | 2/2006 | Seki et al. |
| 7,011,386 | B2 | 3/2006 | Iwasaki et al. |
| 7,374,267 | B2 | 5/2008 | Oshio et al. |
| 7,448,721 | B2 | 11/2008 | Oshio et al. |
| 7,465,006 | B2 | 12/2008 | Edamura et al. |

(Continued)

FOREIGN PATENT DOCUMENTS

| | | |
|---|---|---|
| EP | 1 145 857 A2 | 10/2001 |
| JP | 2000-233518 A | 8/2000 |

OTHER PUBLICATIONS

U.S. Appl. No. 15/649,789, filed Jul. 14, 2017 (First named inventor: Rinako Kameshima).

(Continued)

*Primary Examiner* — Sharon A Polk
(74) *Attorney, Agent, or Firm* — Venable LLP

(57) ABSTRACT

An inkjet printing apparatus and its control method which can suppress defective ejection and wasteful ink consumption are provided. For that purpose, pigment density $N_x$ of the ink in a circulation path is calculated, and the ink in the circulation path is discharged on the basis of the pigment density $N_x$.

7 Claims, 28 Drawing Sheets

(56) References Cited

U.S. PATENT DOCUMENTS

| | | | |
|---|---|---|---|
| 7,673,959 | B2 | 3/2010 | Maru et al. |
| 9,096,065 | B2 | 8/2015 | Nakano et al. |
| 9,108,410 | B2 | 8/2015 | Hamasaki et al. |
| 9,108,425 | B2 * | 8/2015 | Kashu ..... B41J 2/1404 |
| 9,387,679 | B2 | 7/2016 | Shiiba et al. |
| 9,446,595 | B2 | 9/2016 | Takarabe et al. |
| 2004/0150682 | A1 | 8/2004 | Sakamoto et al. |
| 2006/0087539 | A1 | 4/2006 | Loyd et al. |
| 2008/0079759 | A1 | 4/2008 | Nagashima |
| 2013/0100200 | A1 | 4/2013 | Hamasaki et al. |
| 2016/0052278 | A1 | 2/2016 | Iwasaki et al. |

OTHER PUBLICATIONS

European Search Report issued in corresponding European Application No. 17000985.6 dated Nov. 6, 2017.

* cited by examiner

INKJET PRINTING APPARATUS AND CONTROL METHOD

BACKGROUND OF THE INVENTION

Field of the Invention

The present invention relates to an inkjet printing apparatus which performs printing by ejecting an ink from an ejection port and its control method.

Description of the Related Art

In the inkjet printing apparatus, in a case where a state without ejecting an ink for a long time lasts, moisture in the ink evaporates from the ejection port included in the print head, and ink density increases. In a case where the ink density increases, ink viscosity also increases, and defective ejection can occur easily in ejection. In order to suppress a rise in the ink density caused by defective ejection or moisture evaporation from the ejection port as above, preliminary ejection is performed.

Japanese Patent Laid-Open No. 2000-233518 discloses that the preliminary ejection operation is performed while capping left time or total printing time is short, while a cleaning operation is performed in a case the capping left time or the printing time becomes long depending on a relationship between the capping left time or the total printing time.

Moreover, a lengthy line-type print head in which a plurality of print element substrates are arranged regularly is known, and constitution in which the ink is circulated along an ink channel in the print head with the purpose of suppressing thickening of the ink or discharge of the thickened ink or a foreign substance in the ink is known.

In the constitution of circulating the ink, since fresh ink is supplied to the ejection port at all times, the moisture continuously evaporates from the ejection port during the circulation. Since the moisture evaporates at the ejection port and the thickened ink returns into the circulation path, thickening of the ink in the circulation path gradually advances. Thus, in a case where a degree of thickening in the circulation path has advanced even in the case where the capping left time or the printing time is under the same condition, recovery of an ejection state cannot be complete only with the preliminary ejection operation, and defective ejection occurs.

Moreover, in a case where the cleaning operation is applied uniformly, the ink is wastefully consumed in a case where the degree of thickening in the circulation path has not advanced.

SUMMARY OF THE INVENTION

Thus, the present invention provides an inkjet printing apparatus and its control method that can suppress defective ejection and wasteful consumption of the ink.

Thus, an inkjet printing apparatus of the present invention is an inkjet printing apparatus including: a print head configured to print an image by ejecting an ink from the ejection port, a tank configured to store the ink supplied to the print head, a connection channel for connecting the print head to the tank, a circulation path including the print head, the tank, and the connection channel and configured to circulate the ink between the print head and the tank; and a discharging unit configured to perform a discharging operation for discharging the ink in the circulation path, and the inkjet printing apparatus further including: a calculating unit configured to calculate a value relating to ink density in the circulation path; and a control unit configured to cause the discharging unit to perform the discharging operation on the basis of the value relating to the ink density calculated by the calculating unit.

According to the present invention, the inkjet printing apparatus and its control method which can suppress defective ejection and wasteful consumption of the ink can be realized.

Further features of the present invention will become apparent from the following description of exemplary embodiments with reference to the attached drawings.

DESCRIPTION OF THE EMBODIMENTS

A first embodiment of the present invention will be described below by referring to the attached drawings.

(First Embodiment)

(Description of Inkjet Printing Apparatus)

Figure 1:
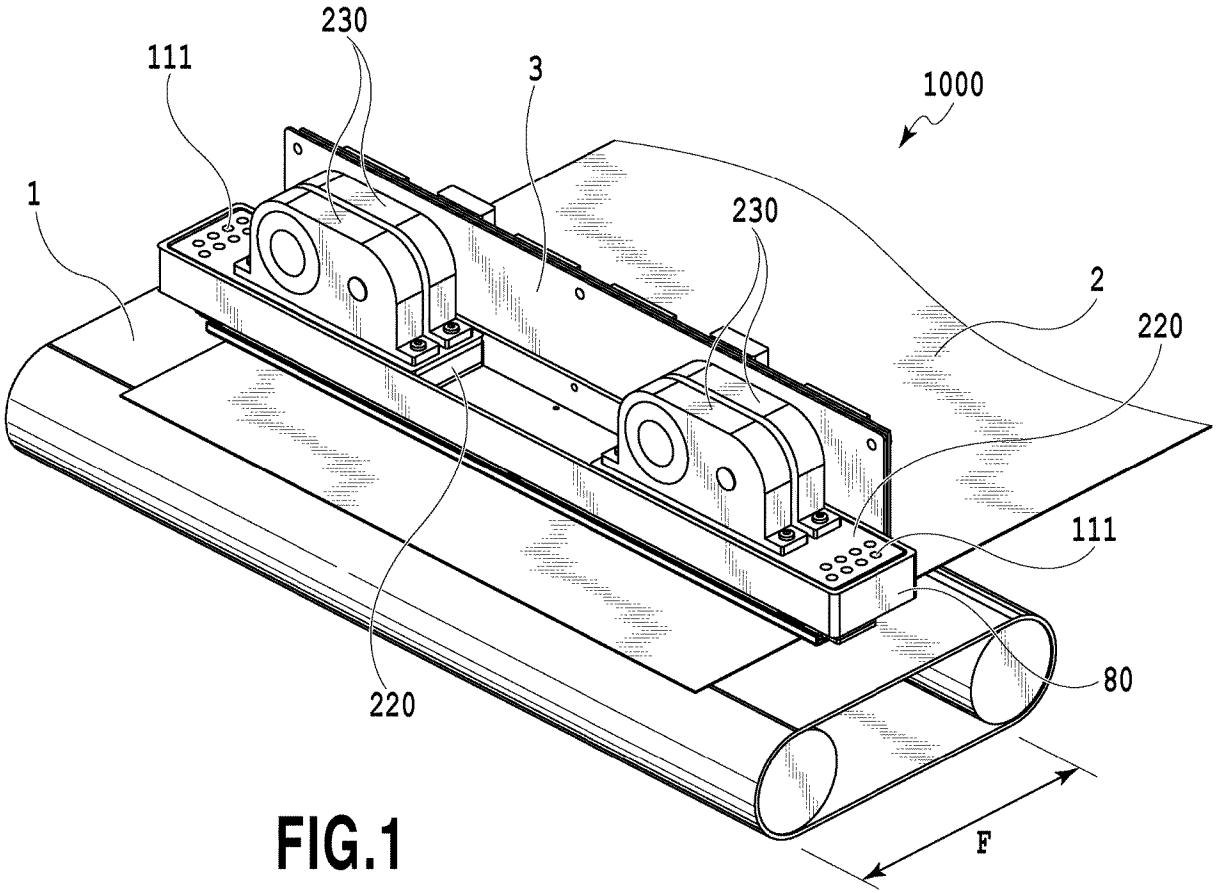
FIG. 1 is a view illustrating outline constitution of an inkjet printing apparatus.

FIG. 1 is a view illustrating outline constitution of a liquid ejecting device for ejecting a liquid of the present invention or particularly an inkjet printing apparatus (hereinafter, also referred to as a printing apparatus) 1000 which performs printing by ejecting ink. The printing apparatus 1000 is a line-type printing apparatus including a conveyance unit 1 which conveys a printing medium 2, and a line-type print head (liquid ejection head) 3 arranged substantially orthogonally to a conveyance direction of the printing medium 2, in which continuous printing is performed in a single pass while continuously or intermittently conveying a plurality of printing mediums 2. The print head 3 includes a negative pressure control unit 230 which controls a pressure (negative pressure) in a path, a liquid supply unit 220 having fluid communication with the negative pressure control unit 230, a liquid connection portion 111 which is a port for supply and discharge of the ink to/from the liquid supply unit 220, and a housing 80. The printing medium 2 is not limited to a cut sheet but may be a continuous roll medium.

The print head 3 is capable of full-color printing by ink in cyan C, magenta M, yellow Y, and black K, and a liquid supply unit which is a supply path for supplying the liquid to the print head 3 and a main tank (see FIG. 3 which will be described later) are connected fluidically. Moreover, to the print head 3, an electric control unit which transfers power and ejection control signals to the print head 3 is electrically connected. A liquid path and an electric signal path in the print head 3 will be described later.

The printing apparatus 1000 is an inkjet printing apparatus in a form for circulating a liquid such as ink between the tank which will be described later and the print head 3 (in the apparatus). A form of the circulation is the circulation form of circulation by making a circulation pump operable on a downstream side of the print head 3. Hereinafter, this circulation form will be described.

Figure 2:
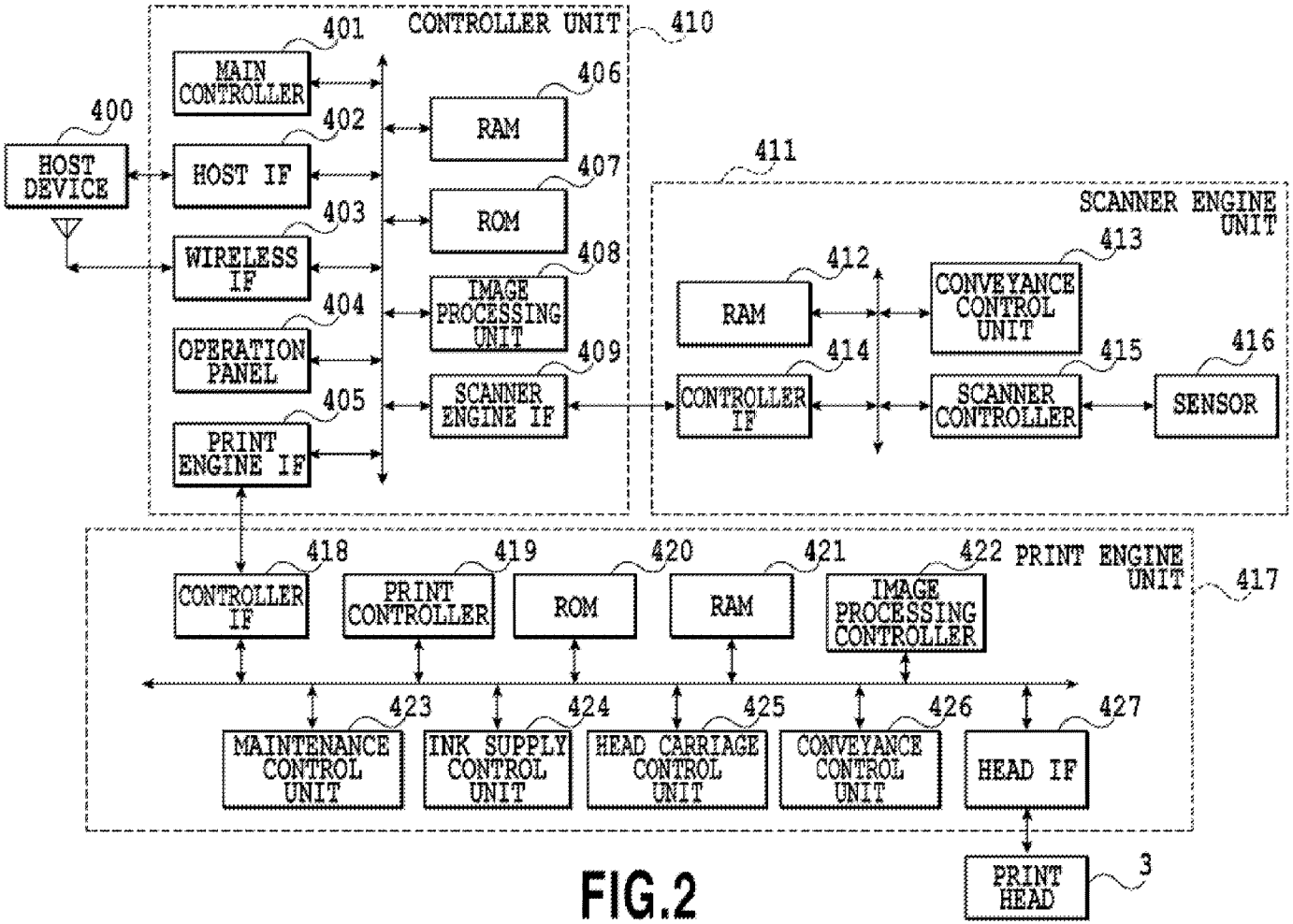
FIG. 2 is a block diagram illustrating control configuration.

FIG. 2 is a block diagram illustrating a control constitution in the printing apparatus 1. The control constitution is mainly made of a print engine unit 417 integrally controls a printing unit, a scanner engine unit 411 which integrally controls a scanner unit, and a controller unit 410 which integrally controls the entire printing apparatus 1000. A print controller 419 controls various mechanisms of the print engine unit 417 in accordance with an instruction of a main controller 401 of the controller unit 410. The various mechanisms of the scanner engine unit 411 are controlled by the main controller 401 of the controller unit 410. Details of the control constitution will be described below.

In the controller unit 410, the main controller 401 constituted by a CPU controls the entire printing apparatus 1000 using a RAM 406 as a work area in accordance with a program and various parameters stored in a ROM 407. For example, in a case where a print job is input from a host device 400 via a host I/F 402 or a wireless I/F 403, an image processing unit 408 applies predetermined image processing to image data received in accordance with an instruction of the main controller 401. Then, the main controller 401 transmits the image data to which image processing has been applied to the print engine unit 417 via a print engine I/F 405.

The printing apparatus 1000 may obtain image data from the host device 400 via wireless communication or wired communication or may obtain the image data from an external storage device (USB memory or the like) connected to the printing apparatus 1000. A communication method used in the wireless communication or wired communication is not limited. For example, as the communication method used in the wireless communication, Wi-Fi (Wireless Fidelity) (registered trademark) or Bluetooth (registered trademark) can be applied. As the communication method used for the wired communication, USB (Universal Serial Bus) or the like can be applied. Moreover, in a case where a read-out command is input from the host device 400, for example, the main controller 401 transmits this command to the scanner unit via the scanner engine I/F 409.

The operation panel 404 is a mechanism for a user to perform input/output with respect to the printing apparatus 1000. The user can instruct an operation such as copying, scanning or the like, set a print mode, recognize information of the printing apparatus 1 or the like through the operation panel 404.

In the print engine unit 417, the print controller 419 constituted by the CPU controls various mechanisms included in the printing unit using a RAM 421 as a work area in accordance with the program and the various parameters stored in a ROM 420. In a case where the various commands and image data are received through a controller I/F 418, the print controller 419 temporarily stores them in the RAM 421. The print controller 419 causes an image processing controller 422 to convert the stored image data to print data so that the print head 3 can use it for the printing operation. In a case where the print data is generated, the print controller 419 causes the print head 3 to perform the printing operation based on the print data through the head I/F 427. At this time, the print controller 419 drives the conveyance unit 1 through a conveyance control unit 426 and conveys the printing medium 2. In accordance with the instruction of the print controller 419, the printing operation by the print head 3 is performed in conjunction with a conveying operation of the printing medium 2, and printing processing is executed.

Ahead carriage control unit 425 changes a direction or a position of the print head 3 in accordance with an operation state such as a maintenance state and a printing state of the printing apparatus 1000. An ink supply control unit 424 controls the liquid supply unit 220 so that a pressure of the ink to be supplied to the print head 3 is contained within an appropriate range. A maintenance control unit 418 controls an operation of a cap unit or a wiping unit in a maintenance unit in a case where a maintenance operation is to be performed for the print head 3.

In the scanner engine unit 411, the main controller 401 controls a hardware resource of a scanner controller 415 while using the RAM 406 as the work area in accordance with the program and the various parameters stored in the ROM 407. As a result, the various mechanisms included in the scanner unit are controlled. For example, in a case where the main controller 401 controls the hardware resource in the scanner controller 415 through the controller I/F 414, a document mounted by the user on an ADF is conveyed through a conveyance control unit 413 and is read by a sensor 416. Then, the scanner controller 415 stores the read-out image data in the RAM 412. The print controller 419 can cause the print head 3 to perform the printing operation based on the image data read out by the scanner controller 415 by converting the image data obtained as described above to print data.

(Description of Circulation Form)

Figure 3:
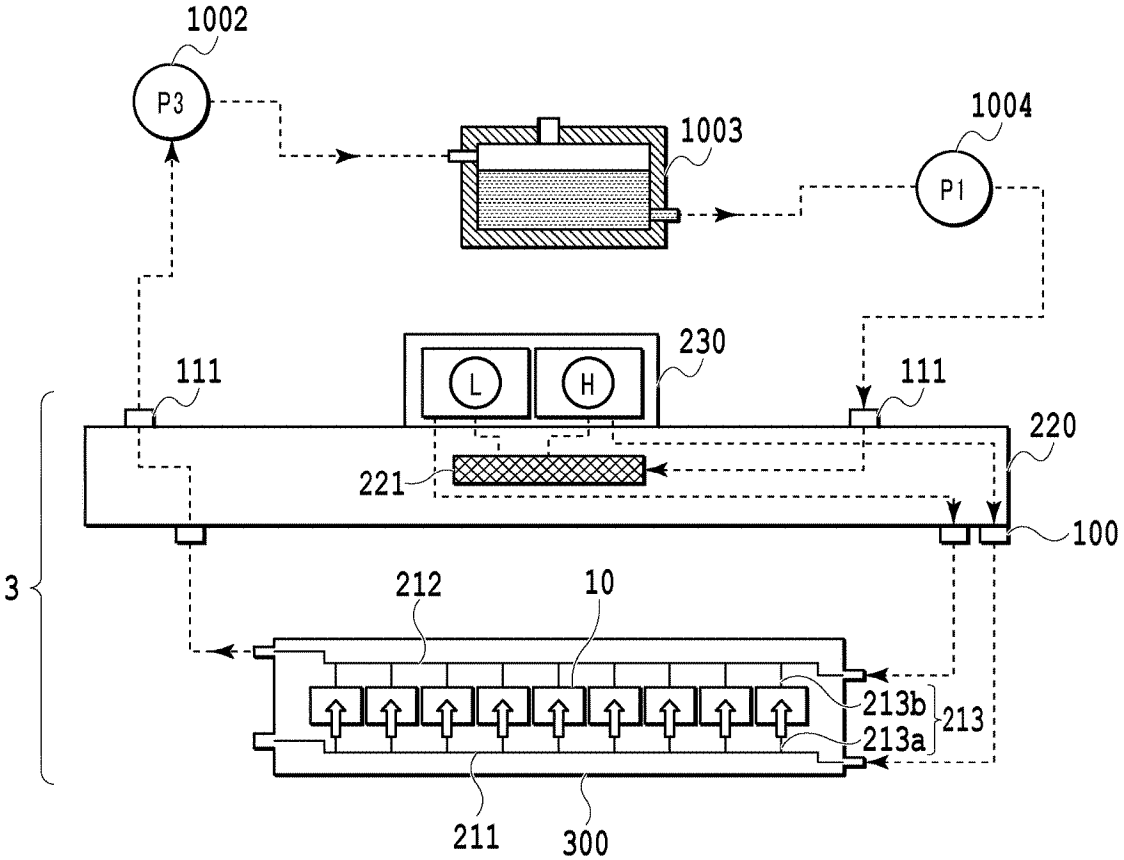
FIG. 3 is a schematic view illustrating a circulation form of a circulation channel applied to the printing apparatus.

FIG. 3 is a schematic view illustrating a circulation form of a circulation path applied to the printing apparatus 1000 of this embodiment. The print head 3 is fluidically connected to a first circulation pump 1002 and a main tank 1003 and the like. In FIG. 3, only a path through which the ink in one color in cyan C, magenta M, yellow Y, and black K flow is illustrated for facilitation of the description, but the circulation paths for the four colors are actually provided in the print head 3 and a printing apparatus body.

The ink in the main tank 1003 is supplied to the liquid supply unit 220 of the print head 3 by a second circulation pump 1004 through the liquid connection unit 111. After that, the ink adjusted to two different negative pressures (a high pressure and a low pressure) in the negative pressure control unit 230 connected to the liquid supply unit 220 is divided into two channels on a high pressure side and on a low pressure side and circulated. The ink in the print head 3 is circulated in the print head by an action of the first circulation pump 1002 located on a downstream of the print head 3, is discharged from the print head 3 through the liquid connection unit 111 and is returned to the main tank 1003.

The first circulation pump 1002 withdraws the liquid from the liquid connection unit 111 of the print head 3 and is made to flow to the main tank 1003. As the first circulation pump, a volume type pump having a quantitative liquid feeding capacity is preferable. Specifically, a tube pump, a gear pump, a diaphragm pump, a syringe pump and the like can be cited, but a form of ensuring a contestant flow rate by arranging a general constant flow valve or a relief valve at a pump outlet may be employed, for example. During driving of the print head 3, by operating the first circulation pump 1002, a predetermined flow rate of the ink flows through a common supply channel 211 and a common recovery channel 212, respectively. By having the ink to flow as above, a temperature of the print head 3 during printing is maintained at an optimal temperature.

The predetermined flow rate during driving of the print head 3 is preferably set to a flow rate or more that can be maintained to such a degree that a temperature difference between each of the print element substrates 10 in the print head 3 does not affect a print quality. However, in a case where it is set to a flow rate which is too large, a negative pressure difference between each of the print element substrates 10 becomes larger due to an influence of a pressure loss in the channel in a liquid ejection unit 300, and density unevenness in the image occurs. Thus, a flow rate is preferably set by giving consideration to the temperature difference and the negative pressure difference between each of the print element substrates 10.

The negative pressure control unit 230 is provided in a path between the second circulation pump 1004 and the liquid ejection unit 300. This negative pressure control unit 230 operates so as to maintain the pressure on the downstream side (that is, the liquid ejection unit 300 side) of the negative pressure control unit 230 at a certain pressure set in advance even if the flow rate of the ink in a circulation system is varied by a difference in the ejection amount per unit area and the like. As two negative pressure control mechanisms constituting the negative pressure control unit 230, any mechanism may be used as long as the pressure on the downstream of the negative pressure control unit 230 can be controlled to fluctuation within a certain range or less around a desired set pressure.

As an example, a mechanism similar to a so-called "pressure reducing regulator" can be employed. In the circulation channel in this embodiment, an upstream side of the negative pressure control unit 230 is pressurized by the second circulation pump 1004 through the liquid supply unit 220. As a result, since an influence of a water head pressure to the print head 3 of the main tank 1003 can be suppressed, a degree of freedom of a layout of the main tank 1003 in the printing apparatus 1000 can be widened.

As the second circulation pump 1004, it only needs to have a certain pressure or more of a head pressure within a range of an ink circulation flow rate used in driving of the print head 3, and a turbo-type pump or a volume-type pump can be used. Specifically, a diaphragm pump or the like can be applied. Moreover, instead of the second circulation pump 1004, a water head tank arranged with a certain water head difference with respect to the negative pressure control unit 230, for example, can be also applied. As illustrated in FIG. 3, the negative pressure control unit 230 includes two negative pressure adjustment mechanisms for which control pressures different from each other are set for each. In the two negative pressure adjustment mechanisms, a relatively high pressure setting side (described as H in FIG. 3) and a relatively low pressure setting side (described as L in FIG. 3) are connected to the common supply channel 211 and the common recovery channel 212 in the liquid discharge unit 300 through the inside of the liquid supply unit 220, respectively.

In the liquid ejection unit 300, the common supply channel 211, the common recovery channel 212, and an individual channel 215 (an individual supply channel 213 and an individual recovery channel 214) communicating with each of the print element substrates are provided. A negative pressure control mechanism H is connected to the common supply channel 211, and a negative control mechanism L is connected to the common recovery channel 212, and a differential pressure is generated between the two common channels. Since the individual channel 215 communicates with the common supply channel 211 and the common recovery channel 212, a flow (an arrow in FIG. 3) of a part of the liquid flowing from the common supply channel 211 to the common recovery channel 212 through an internal channel of the print element substrate 10 is generated.

As a result, in the liquid ejection unit 300, a flow in which a part of the liquid passes through each of the print element substrates 10 is generated while the liquid is made to flow so as to pass through the common supply channel 211 and the common recovery channel 212, respectively. Thus, heat generated in each of the print element substrates 10 can be discharged to an outside of the print element substrates 10 by the ink flowing through the common supply channel 211 and the common recovery channel 212. Moreover, by means of such constitution, when the printing is being performed by the print head 3, the flow of the ink can be generated also in the ejection port or a pressure chamber without performing ejection. As a result, by lowering viscosity of the ink thickened in the ejection port, thickening of the ink can be suppressed. Moreover, the thickened ink or a foreign substance in the ink can be discharged into the common recovery channel 212. Thus, the print head 3 of this embodiment becomes capable of printing at a high speed and with a high quality.

Assume that a total of the flow rates in the common supply channel 211 and the common recovery channel 212 in a case where the ink is circulated during printing standby (non-printing) is a flow rate A. A value of the flow rate A is defined as a minimum flow rate required for keeping the temperature difference in the liquid ejection unit 300 within a desired range in temperature adjustment of the print head 3 during the printing standby. Moreover, an ejection flow rate in a case where the ink is ejected from all the ejection ports of the liquid ejection unit 300 (full ejection) is defined as a flow rate F (an ejection amount per ejection port× ejection frequency per unit time×number of ejection ports).

Figure 4:
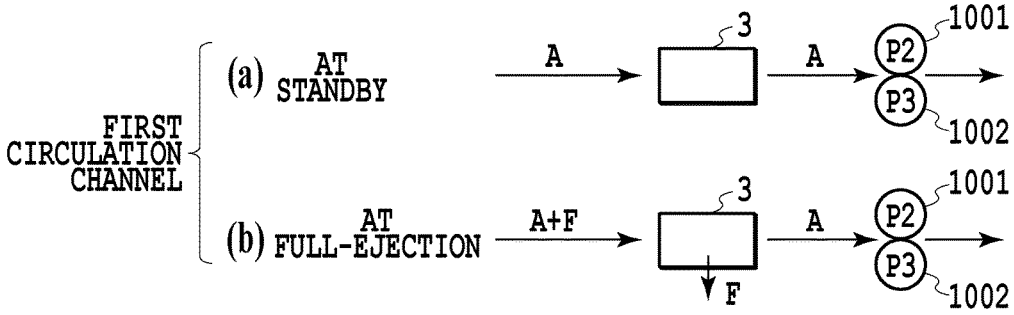
FIG. 4 is a schematic view illustrating an ink inflow amount into a print head.

FIG. 4 is a schematic view illustrating an inflow amount of the ink into the print head 3 in the circulation form of this embodiment. A portion (a) indicates standby in the circulation form and a portion (b) indicates the full ejection in the circulation form, and the portion (a) and the portion (b) indicate the flowrates at standby and at the full ejection.

In the case of the circulation form (portion (a), portion (b)) where the first circulation pump 1002 having a quantitative liquid feeding capacity is arranged on the downstream side of the print head 3, a set flow rate of the first circulation pump 1002 is the flow rate A. By means of this flow rate A, temperature management in the liquid ejection unit 300 in standby is made possible. Then, in the case of the full ejection by the print head 3, the set flow rate of the first circulation pump 1002 is still the flow rate A. However, regarding a maximum flow rate supplied to the print head 3, a negative pressure generated by the ejection acts in the print head 3, and the flow rate F for a consumed portion by the full ejection is added to the flow rate A of the total set flow rate. Thus, the flow rate F is added to the flow rate A, and the maximum value of the supply amount to the print head 3 is the flow rate A+the flow rate F (portion (b)).

(Description of Print Head Constitution)

Figure 5A:
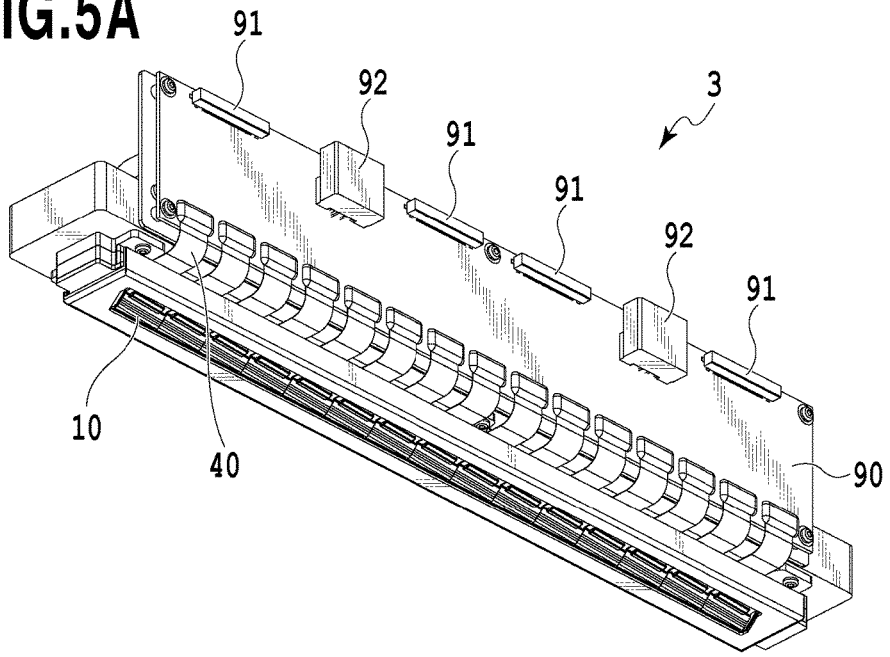
FIG. 5A is a perspective view illustrating the print head.
Figure 5B:
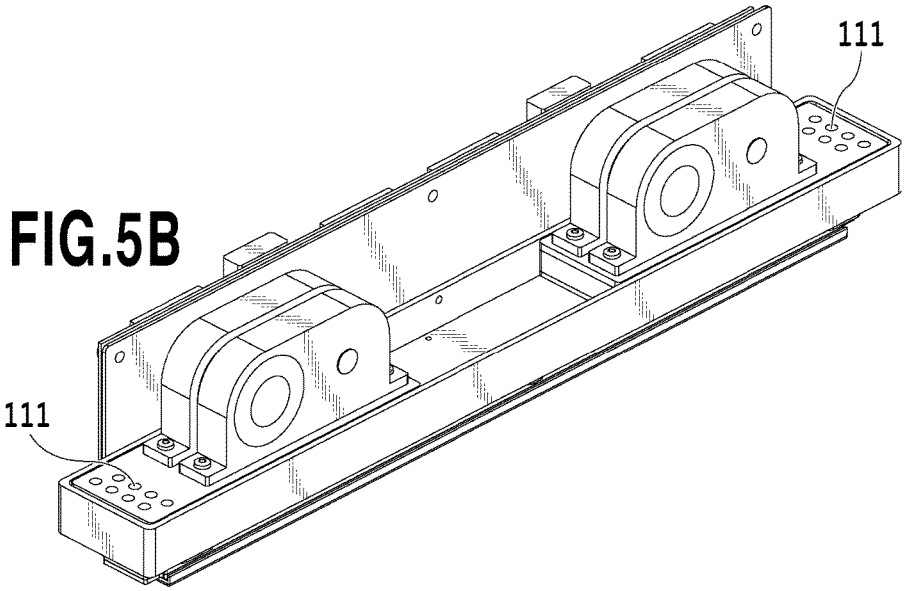
FIG. 5B is a perspective view illustrating the print head.

Constitution of the print head 3 according to the first embodiment will be described. FIGS. 5A and 5B are perspective views illustrating the print head 3 according to this embodiment. The print head 3 is a line-type print head in which 15 print element substrates 10 capable of ejecting the ink in four colors, that is, cyan C/magenta M/yellow Y/black K with the one print element substrate 10 are arrayed on a straight line (inline arrangement). As illustrated in FIG. 5A, the print head 3 includes a signal input terminal 91 and a power supply terminal 92 electrically connected to each of the print element substrates 10 through a flexible wiring substrate 40 and an electric wiring substrate 90. The signal input terminal 91 and the power supply terminal 92 are electrically connected to the control unit of the printing apparatus 1000 and supply an ejection driving signal and power required for ejection to the print element substrate 10, respectively. By integrating wirings by an electric circuit in the electric wiring substrate 90, the numbers of the signal input terminals 91 and the power supply terminals 92 can be made smaller than the number of print element substrates 10. As a result, the number of electric connection portions requiring removal when the print head 3 is to be assembled to the printing apparatus 1000 or at replacement of the print head can be smaller. As illustrated in FIG. 5B, the liquid connection portion 111 provided at both end portions of the print head 3 is connected to the liquid supply system of the printing apparatus 1000. As a result, the ink in four colors of cyan C/magenta M/yellow Y/black K is supplied from the supply system of the printing apparatus 1000 to the print head 3, and the ink having passed through the print head 3 is recovered to the supply system of the printing apparatus 1000. As a result, the ink in each color is capable of circulation through the path of the printing apparatus 1000 and the path of the print head 3.

Figure 6:
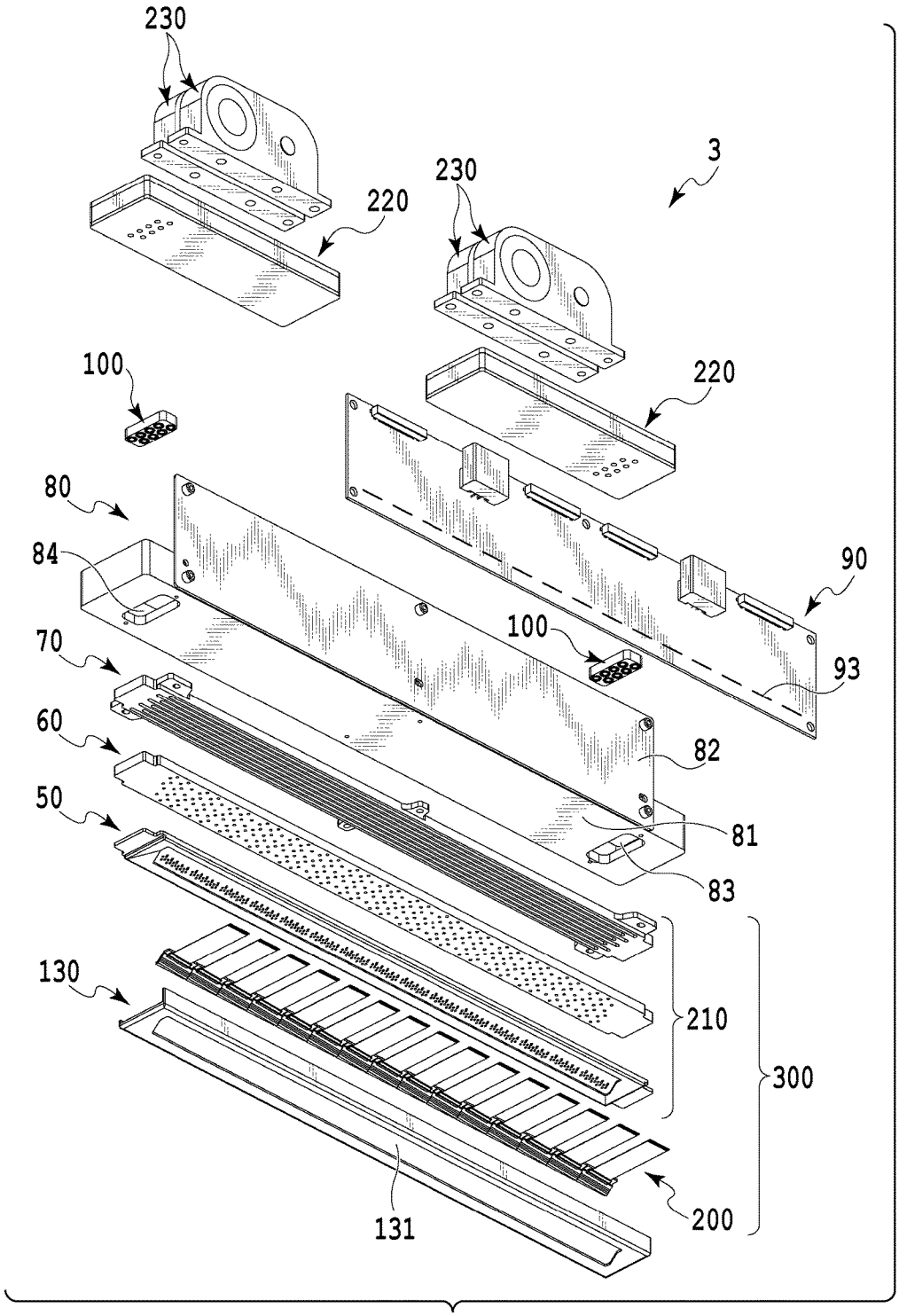
FIG. 6 is an exploded perspective view illustrating each component or unit constituting the print head.

FIG. 6 is an exploded perspective view illustrating each component or unit constituting the print head 3. The liquid ejection unit 300, the liquid supply unit 220, and the electric wiring substrate 90 are mounted on the housing 80. The liquid connection portion 111 (see FIG. 3) is provided on the liquid supply unit 220, and inside the liquid supply unit 220, a filter 221 in each color (see FIG. 3) communicating with each opening of the liquid connection portion 111 is provided in order to remove the foreign substance in the supplied ink. In the two liquid supply units 220, the filters 221 in two colors each are provided, respectively. The liquid having passed through the filter 221 is supplied to the negative pressure control unit 230 arranged on the liquid supply unit 220 corresponding to each color. The negative pressure control unit 230 is a unit made of the negative pressure control valve in each color and drastically damps a pressure loss change in the supply system of the printing apparatus 1000 (supply system on the upstream side of the print head 3) generated with fluctuation in the flow rate of the liquid due to the action of a valve or a spring member or the like provided inside thereof, respectively. As a result, the negative pressure control unit 230 can stabilize a negative pressure change on the downstream side (liquid ejection unit 300 side) from the negative pressure control unit within a certain range. In the negative pressure control unit 230 in each color, two negative pressure control valves in each color as described in FIG. 3 are incorporated. The two negative pressure control valves are set to control pressures different from each other, and a high pressure side communicates with the common supply channel 211 (see FIG. 3) in the liquid ejection unit 300 and a low pressure side with the common recovery channel 212 (see FIG. 3) through the liquid supply unit 220.

The housing 80 is constituted by a liquid ejection unit support portion 81 and an electric wiring substrate support portion 82 and supports the liquid ejection unit 300 and the electric wiring substrate 90 and also ensures rigidity of the print head 3. The electric wiring substrate support portion 82 is for supporting the electric wiring substrate 90 and is fixed to the liquid ejection unit support portion 81 by screwing. The liquid ejection unit support portion 81 has a role of correcting warping or deformation of the liquid ejection unit 300 and of ensuring relative position accuracy of a plurality of the print element substrates 10, whereby streaks or unevenness in a printed matter are suppressed. Thus, the liquid ejection unit support portion 81 preferably has sufficient rigidity and as a material, a metal material such as SUS or aluminum or ceramic such as alumina is preferable. In the liquid ejection unit support portion 81, openings 83 and 84 to which a joint rubber 100 is to be inserted are provided. The liquid supplied from the liquid supply unit 220 is led to a third channel member 70 constituting the liquid ejection unit 300 through the joint rubber.

The liquid ejection unit 300 is made of a plurality of ejection modules 200 and a channel member 210, and a cover member 130 is mounted on a surface of a printing medium side of the liquid ejection unit 300. Here, the cover member 130 is a member having a frame-shaped surface in which a lengthy opening 131 is provided as illustrated in FIG. 6, and the print element substrate 10 and a sealing member 110 (see FIG. 10A which will be described later) included in the ejection module 200 are exposed from the opening 131. A frame part around the opening 131 has a function as a contact surface of the cap member which caps the print head 3 in print standby (non-printing). Thus, it is preferable that a closed space is formed in capping by filling irregularity or a gap on an ejection port surface of the liquid ejection unit 300 by applying an adhesive, a sealing material, a filling material or the like along the periphery of the opening 131.

Subsequently, constitution of the channel member 210 included in the liquid ejection unit 300 will be described. As illustrated in FIG. 6, the channel member 210 is made by laminating a first channel member 50, a second channel member 60, and a third channel member 70 and distributes the liquid supplied from the liquid supply unit 220 to each of the ejection modules 200. Moreover, the channel member 210 is a channel member for returning the liquid circulating from the ejection module 200 to the liquid supply unit 220. The channel member 210 is fixed to the liquid ejection unit support portion 81 by screwing, whereby warping or deformation of the channel member 210 is suppressed.

Figure 7:
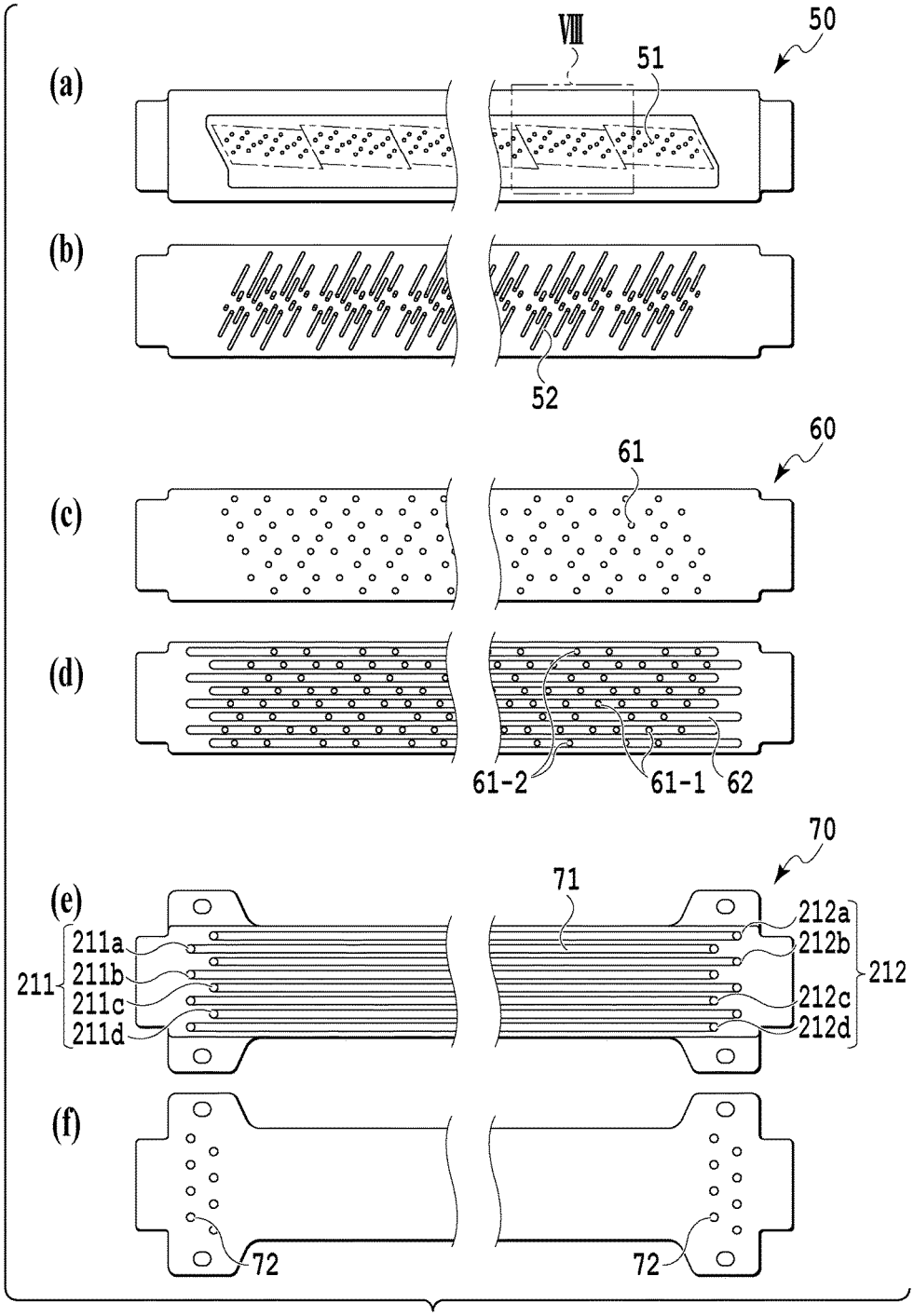
FIG. 7 is a view illustrating a front surface and a rear surface of each channel member of first to third channel members.

FIG. 7 is a view illustrating a front surface and a rear surface of each of the channel members of the first to third channel members. A portion (a) illustrates a surface of the first channel member 50 on a side where the ejection module 200 is mounted, and a portion (f) illustrates a surface of the third channel member 70 on a side in contact with the liquid ejection unit support portion 81. The first channel member 50 and the second channel member 60 are joined so that a portion (b) and a portion (c) which are contact surfaces of the channel members, respectively, are faced with each other, and the second channel member and the third channel member are joined so that a portion (d) and a portion (e) which are contact surfaces of the channel members, respectively, are faced with each other. By joining the second channel member 60 and the third channel member 70, eight common channels (211*a*, 211*b*, 211*c*, 211*d*, 212*a*, 212*b*, 212*c*, 212*d*) extending in a longitudinal direction of the channel members are formed by common channel grooves 62 and 71 formed in each of the channel members.

As a result, a set of the common supply channel 211 and the common recovery channel 212 is formed in the channel member 210 for each color. The ink is supplied from the common supply channel 211 to the print head 3, and the ink having been supplied to the print head 3 is recovered by the common recovery channel 212. A communication port 72 (see a portion (f) in FIG. 7) of the third channel member 70 communicates with each hole of the joint rubber 100 and fluidically communicates with the liquid supply unit 220 (see FIG. 6). In a bottom surface of the common channel groove 62 of the second channel member 60, a plurality of communication ports 61 (a communication port 61-1 communicating with the common supply channel 211 and a communication port 61-2 communicating with the common recovery channel 212) is formed and communicates with one end portion of an individual channel groove 52 of the first channel member 50. A communication port 51 is formed in the other end portion of the individual channel groove 52 of the first channel member 50 and the plurality of ejection modules 200 are fluidically communicated with each other through the communication port 51. By means of this individual channel groove 52, the channels can be integrated to a center side of the channel members.

The first to third channel members preferably have corrosion resistance against the liquid and are made of a material with low linear expansion rate. As the material, composite materials (resin materials) using alumina, LCP (liquid crystal polymer), PPS (poly phenyl sulfide) or PSF (poly sulfone) as a base material and an inorganic filler such as silica particles, fibers or the like is added can be suitably used, for example. As a forming method of the channel member 210, the three channel members may be laminated and bonded to each other or in a case where the resin composite resin material is selected as the material, a joining method by deposition may be used.

Figure 8:
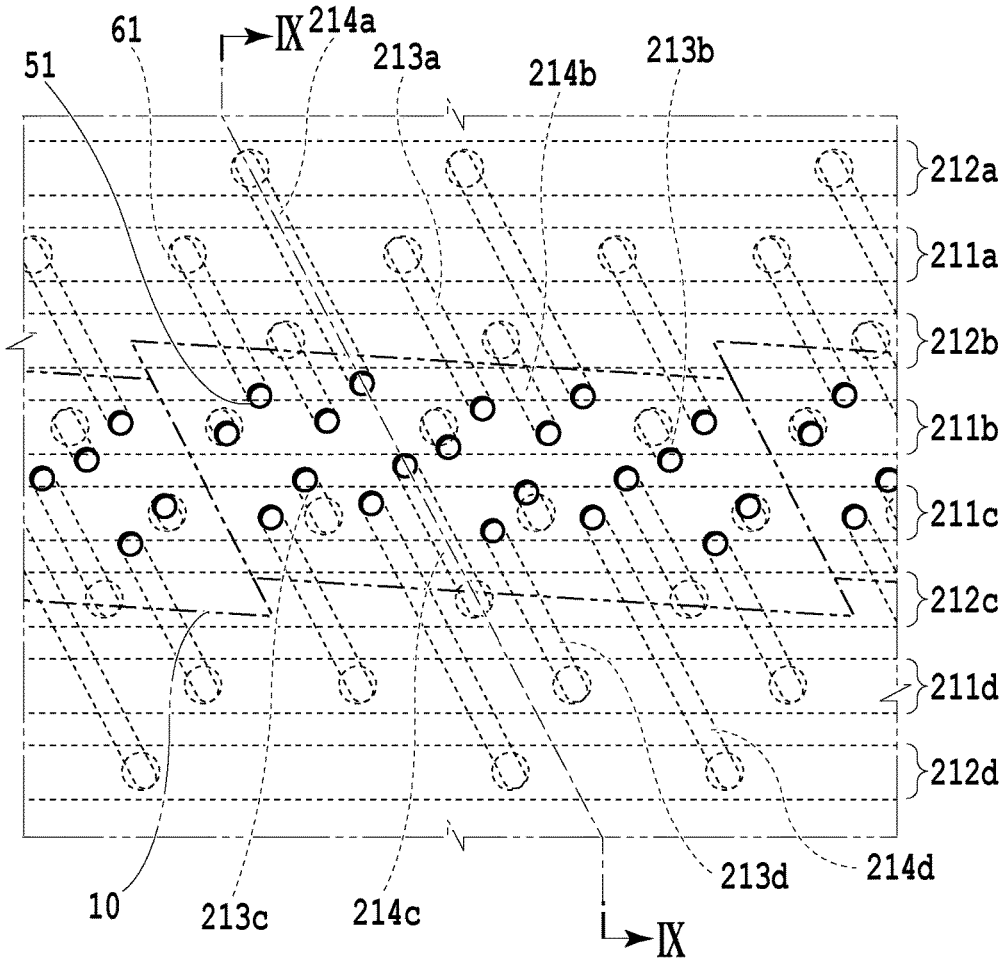
FIG. 8 is a view illustrating an VIII part in a portion (a) in FIG. 7.

FIG. 8 illustrates an VIII part of the portion (a) in FIG. 7 and is a perspective view illustrating a part of the first channel member 50 in the channel member 210 formed by joining the first to third channel members from a surface side where the ejection module 200 is mounted in an enlarged manner. Regarding the common supply channel 211 and the common recovery channel 212, the common supply channel 211 and the common recovery channel 212 are arranged alternately from channels on both end portions. Here, a connection relationship of each channel in the channel member 210 will be described.

In the channel member 210, the common supply channels 211 (211*a*, 211*b*, 211*c*, and 211*d*) and the common recovery channels 212 (212*a*, 212*b*, 212*c*, and 212*d*) extending in the longitudinal direction of the print head 3 in each color are provided. To the common supply channels 211 in each color, a plurality of individual supply channels 213 (213*a*, 213*b*, 213*c*, and 213*d*) formed by the individual channel grooves 52 is connected through the communication port 61. Moreover, to the common recovery channel 212 in each color, a plurality of individual recovery channels 214 (214*a*, 214*b*, 214*c*, and 214*d*) formed by the individual channel grooves 52 are connected through the communication port 61. By means of such channel constitution, the ink can be integrated to the print element substrate 10 located at the center part of the channel member through the individual supply channel 213 from each of the common supply channels 211. Moreover, the ink can be recovered from the print element substrate 10 to each of the common recovery channels 212 through the individual recovery channel 214.

Figure 9:
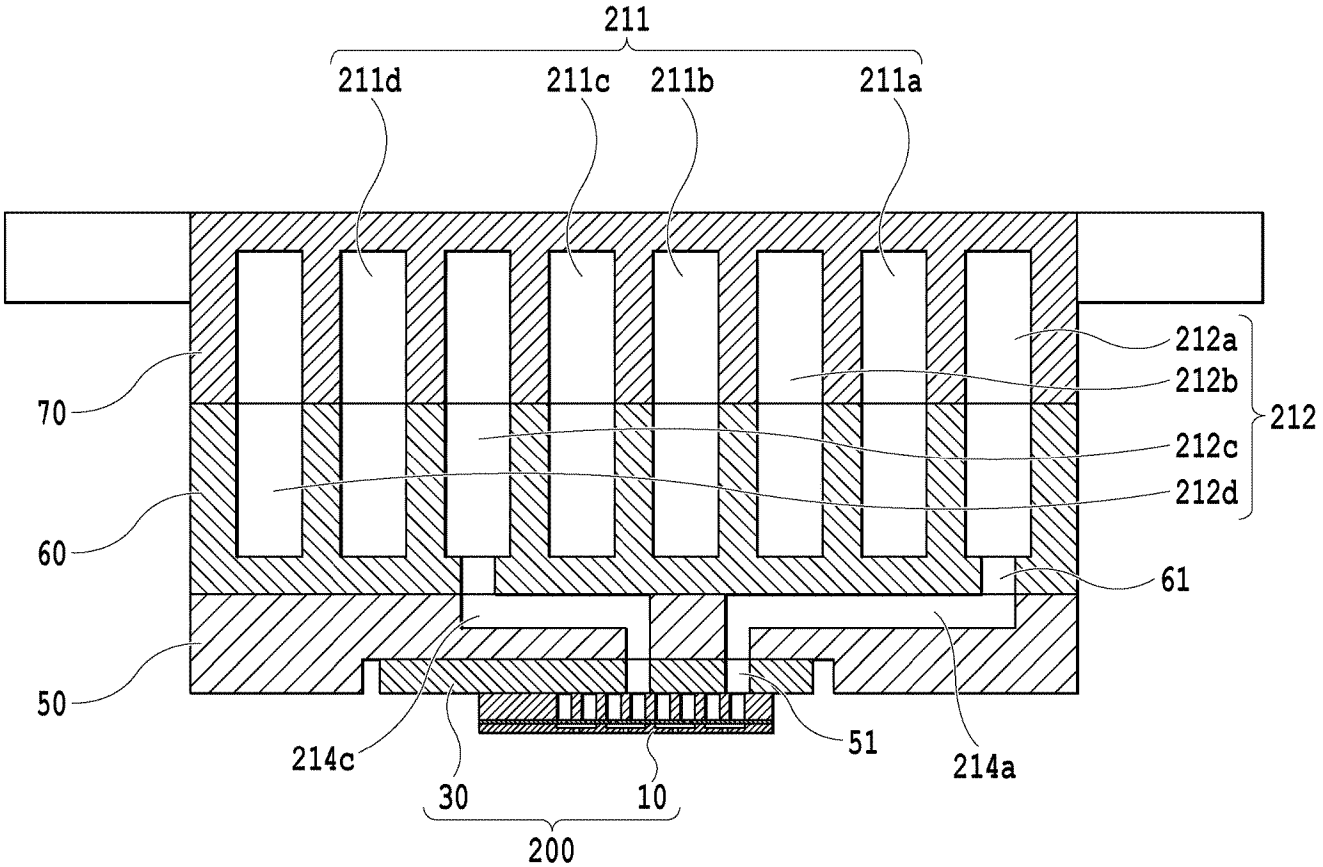
FIG. 9 is a view illustrating a section in IX-IX in FIG. 8.

FIG. 9 is a view illustrating a section on IX-IX in FIG. 8. Each of the individual recovery channels (214*a* and 214*c*) communicates with the ejection module 200 through the communication port 51. In FIG. 9, only the individual recovery channel (214*a* and 214*c*) is illustrated, but in another section, the individual supply channel 213 and the ejection module 200 communicate with each other as illustrated in FIG. 8. In a support member 30 and the print element substrate 10 included in each of the ejection modules 200, a channel for supplying the ink from the first channel member 50 to a print element 15 provided in the print element substrate 10 is formed. Moreover, in the support member 30 and the print element substrate 10, a channel for recovering (returning) a part of or the whole of the liquid supplied to the print element 15 to the first channel member 50 is formed.

Here, the common supply channel 211 in each color is connected to the negative pressure control unit 230 (high pressure side) in a corresponding color through the liquid supply unit 220, and the common recovery channel 212 is connected to the negative pressure control unit 230 (low pressure side) through the liquid supply unit 220. By means of this negative pressure control unit 230, a differential pressure (pressure difference) is generated between the common supply channel 211 and the common recovery channel 212. Thus, as illustrated in FIG. 8 and FIG. 9, in the print head of this embodiment to which each channel is connected, a flow flowing in order from the common supply channel 211—individual supply channel 213—print element substrate 10—individual recovery channel 214—common recovery channel 212 is generated in each color.

(Description of Ejection Module)

Figure 10A:
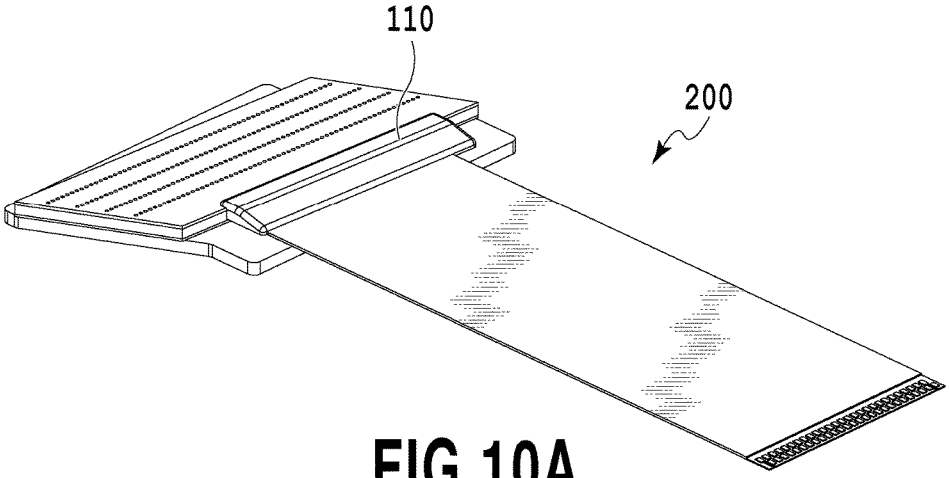
FIG. 10A is a view illustrating one ejection module.
Figure 10B:
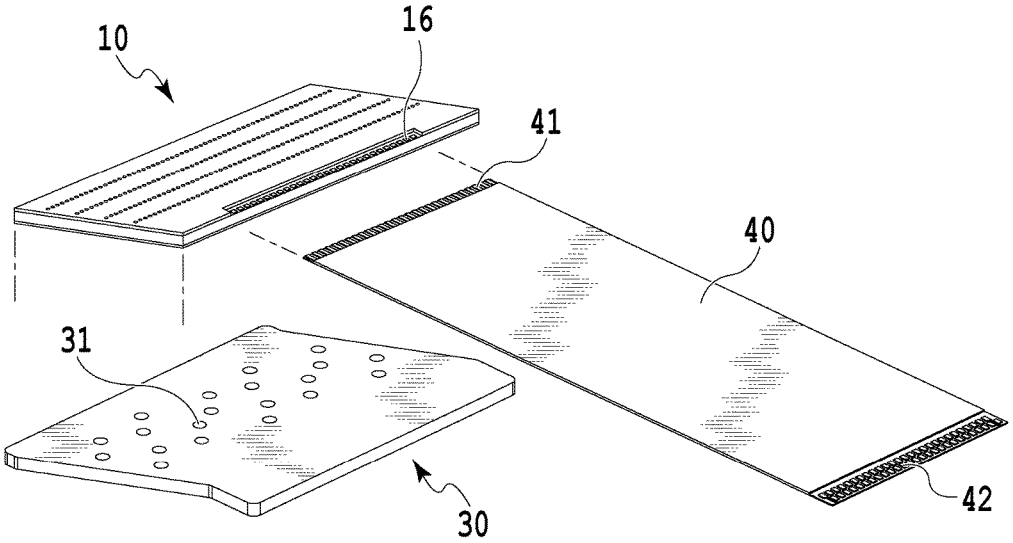
FIG. 10B is a view illustrating the one ejection module.

FIG. 10A is a perspective view illustrating the one ejection module 200, and FIG. 10B is an exploded view thereof. As a manufacturing method of the ejection module 200, first, the print element substrate 10 and the flexible wiring substrate 40 are bonded onto the support member 30 in which a liquid communication port 31 is provided in advance. After that, a terminal 16 on the print element substrate 10 and a terminal on the flexible wiring substrate 40 are electrically connected by wire bonding and after that, a wire bonding portion (electric connection portion) is sealed by covering by the sealing member 110. A terminal 42 of the flexible wiring substrate 40 on a side opposite to the print element substrate 10 is electrically connected to a connection terminal 93 (see FIG. 6) of the electric wiring substrate 90. The support member 30 is a support body for supporting the print element substrate 10 and also is a channel member for causing the print element substrate 10 and the channel member 210 to fluidically communicate with each other and thus, it preferably has high flatness and can be joined to the print element substrate with sufficiently high reliability. As the material, alumina and a resin material, for example, are preferable.

(Description of Structure of Print Element Substrate)

Figure 11A:
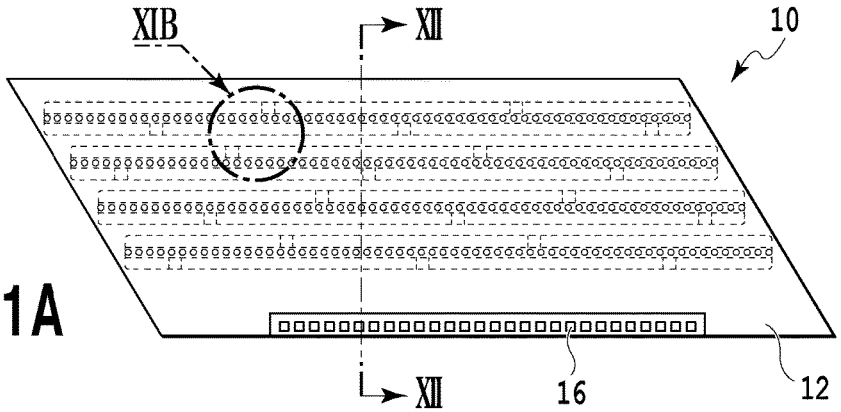
FIG. 11A is a view illustrating a print element substrate.
Figure 11B:
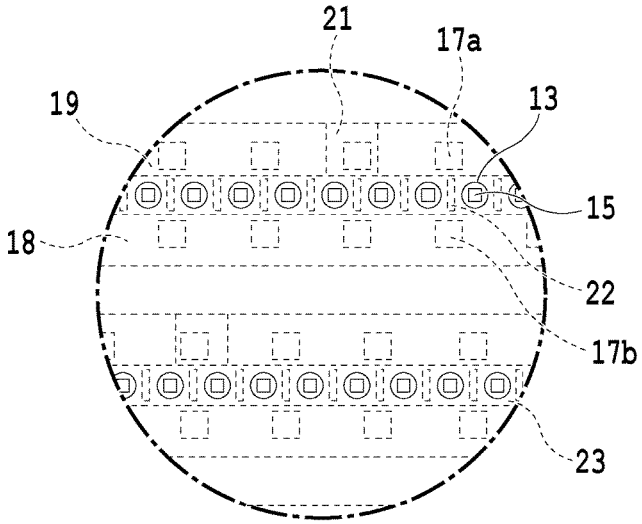
FIG. 11B is a view illustrating the print element substrate.
Figure 11C:
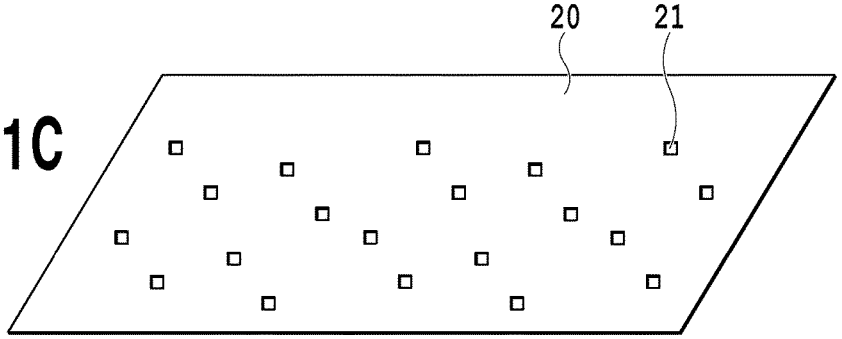
FIG. 11C is a view illustrating the print element substrate.

FIG. 11A illustrates a plan view of a surface on a side where an ejection port 13 of the print element substrate 10 is formed, FIG. 11B illustrates an enlarged view of a portion indicated by XIB in FIG. 11A, and FIG. 11C illustrates a plan view of a rear surface of FIG. 11A. Here, constitution of the print element substrate 10 in this embodiment will be described. As illustrated in FIG. 11A, on an ejection port forming member 12 of the print element substrate 10, four rows of ejection port rows corresponding to each of the ink colors are formed. Hereinafter, a direction where the ejection port row in which a plurality of ejection ports 13 is arrayed extends is referred to as an "ejection port row direction". As illustrated in FIG. 11B, at a position corresponding to each of the ejection ports 13, the print element 15 which is a heat generating element for foaming the liquid by thermal energy is arranged. A pressure chamber 23 including the print element 15 therein is divided by a bulkhead 22.

The print element 15 is electrically connected to the terminal 16 by an electric wiring (not shown) provided on the print element substrate 10. The print element 15 generates heat and boils the liquid on the basis of a pulse signal input from the control circuit of the printing apparatus 1000 through the electric wiring substrate 90 (see FIG. 6) and the flexible wiring substrate 40 (see FIG. 10B). By means of a foaming force by this boiling, the liquid is ejected from the ejection port 13. As illustrated in FIG. 11B, a liquid supply path 18 extends on one side and a liquid recovery path 19 on the other side along each of the ejection port rows. The liquid supply path 18 and the liquid recovery path 19 are channels extending in the ejection port row direction provided on the print element substrate 10 and communicate with the ejection ports 13 through a supply port 17*a* and a recovery port 17*b*, respectively.

As illustrated in FIG. 11C, a sheet-shaped cover plate 20 is laminated on a rear surface of a surface of the print element substrate 10 on which the ejection port 13 is formed, and openings 21 communicating with the liquid supply path 18 and the liquid recovery path 19 are provided in plural on the cover plate 20. In this embodiment, three openings 21 are provided for the one liquid supply path 18 and two openings 21 are provided for the one liquid recovery path 19 on the cover plate 20. As illustrated in FIG. 11B, each of the openings 21 on the cover plate 20 communicates with the plurality of communication ports 51 illustrated in the portion (a) of FIG. 7. The cover plate 20 preferably has sufficient corrosion resistance against the liquid and from the viewpoint of prevention of color mixing, high accuracy is required for an opening shape and an opening position of the opening 21. Thus, as a material of the cover plate 20, a photosensitive resin material or a silicon plate is used, and the opening 21 is preferably provided by a photolithography process. As described above, the cover plate 20 is to convert a pitch of the channels by the openings 21 and considering a pressure loss, its thickness is preferably small and is preferably constituted by a film-state member.

Figure 12:
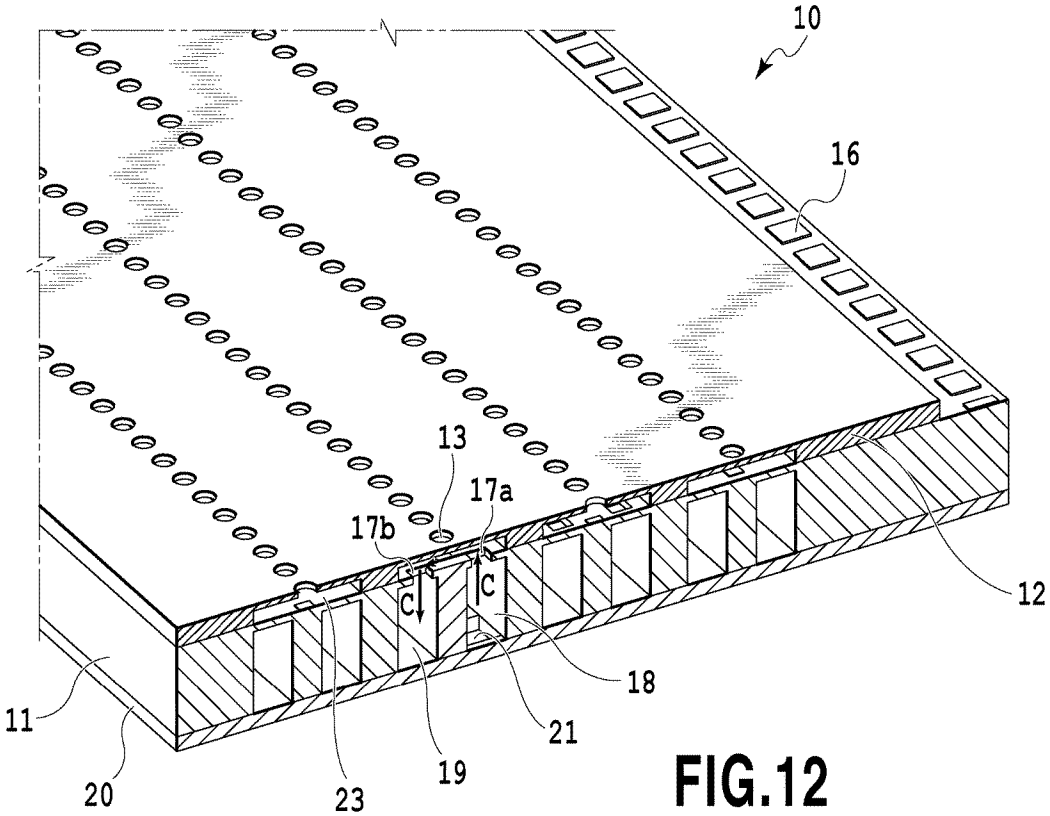
FIG. 12 is a perspective view illustrating a section of the print element substrate and a cover plate.

FIG. 12 is a perspective view illustrating a section of the print element substrate 10 and the cover plate 20 on XII-XII in FIG. 11A. Here, a flow of the liquid in the print element substrate 10 will be described. The cover plate 20 has a function as a cover for forming a part of walls of the liquid supply path 18 and the liquid recovery path 19 formed on the substrate 11 of the print element substrate 10. In the print element substrate 10, the substrate 11 formed of Si and the ejection port forming member 12 formed of a photosensitive resin are laminated, and the cover plate 20 is joined to the rear surface of the substrate 11. On one surface side of the substrate 11, the print elements 15 are formed (see FIG. 11B), and on the rear surface side thereof, grooves forming the liquid supply path 19 and the liquid recovery path 18 extending along the ejection port row are formed.

The liquid supply path 18 and the liquid recovery path 19 formed by the substrate 11 and the cover plate 20 are connected to the common supply channel 211 and the common recovery channel 212 in the channel member 210, respectively, and a differential pressure is generated between the liquid supply path 18 and the liquid recovery path 19. During printing by ejecting the liquid from the ejection port 13, at the ejection port not performing ejection, the liquid in the liquid supply path 18 provided in the substrate 11 is made to flow by this differential pressure to the liquid recovery path 19 through the supply port 17*a*, the pressure chamber 23, and the recovery port 17*b* (an arrow C in FIG. 12). By means of this flow, the thickened ink, foams, foreign substances and the like caused by evaporation from the ejection port 13 in the ejection port 13 or the pressure chamber 23 which stops printing can be recovered to the liquid recovery path 19. Moreover, thickening of the ink in the ejection port 13 and the pressure chamber 23 can be suppressed.

The liquid recovered into the liquid recovery path 19 flows in order of the communication port 51 in the channel member 210 (see FIG. 9), the individual recovery channel 214, and the common recovery channel 212 (see FIG. 9) through the opening 21 of the cover plate 20 and the liquid communication port 31 of the support member 30 (see FIG. 10B). The liquid recovered into the liquid recovery path 19 is recovered into the recovery path of the printing apparatus 1000 by flowing as above. That is, supply and recovery of the liquid is so performed, the liquid supplied to the print head 3 from the printing apparatus body flows in order as described below.

The liquid first flows into the print head 3 from the liquid connection portion 111 of the liquid supply unit 220. Then, the liquid is supplied in the order of the joint rubber 100, the communication port 72 and the common channel groove 71 provided in the third channel member, the common channel groove 62 and the communication port 61 provided in the second channel member, and the individual channel groove 52 and the communication port 51 provided in the first channel member. After that, the liquid is supplied to the pressure chamber 23 through the liquid communication port 31 provided in the support member 30, the opening 21 provided in the cover plate 20, and the liquid supply path 18 and the supply port 17*a* provided in the substrate 11 in this order.

In the liquid supplied to the pressure chamber 23, the liquid not ejected from the ejection port 13 flows in the order of the recovery port 17*b* and the liquid recovery path 19 provided in the substrate 11, the opening 21 provided in the cover plate 20, and the liquid communication port 31 provided in the support member 30. After that, the liquid flows in the order of the communication port 51 and the individual channel groove 52 provided in the first channel member, the communication port 61 and the common channel groove 62 provided in the second channel member, the common channel groove 71 and the communication port 72 provided in the third channel member 70, and the joint rubber 100. Then, the liquid flows to an outside of the print head 3 from the liquid connection portion 111 provided in the liquid supply unit 220.

In the circulation form illustrated in FIG. 3, the liquid having flowed in from the liquid connection portion 111 goes through the negative pressure control unit 230 and then, is supplied to the joint rubber 100. Moreover, not all the liquid having flowed in from the one end of the common supply channel 211 of the liquid ejection unit 300 is supplied to the pressure chamber 23 through the individual supply channel 213*a*. That is, a part of the liquid having flowed in from the one end of the common supply channel 211 does not flow into the individual supply channel 213*a* but flows to the liquid supply unit 220 from the other end of the common supply channel 211.

As described above, by providing a path flowing without going through the print element substrate 10, even in a case where the print element substrate 10 including a channel which is fine and has large flow resistance as in this embodiment, a backflow of a circulation flow of the liquid can be suppressed. As described above, since the print head 3 of this embodiment can suppress thickening of the liquid in the pressure chamber 23 and an ejection port vicinity portion, uneven ejection or non-ejection can be suppressed, and printing with a high image quality can be performed as the result.

(Description of Positional Relationship Between Print Element Substrates)

Figure 13:
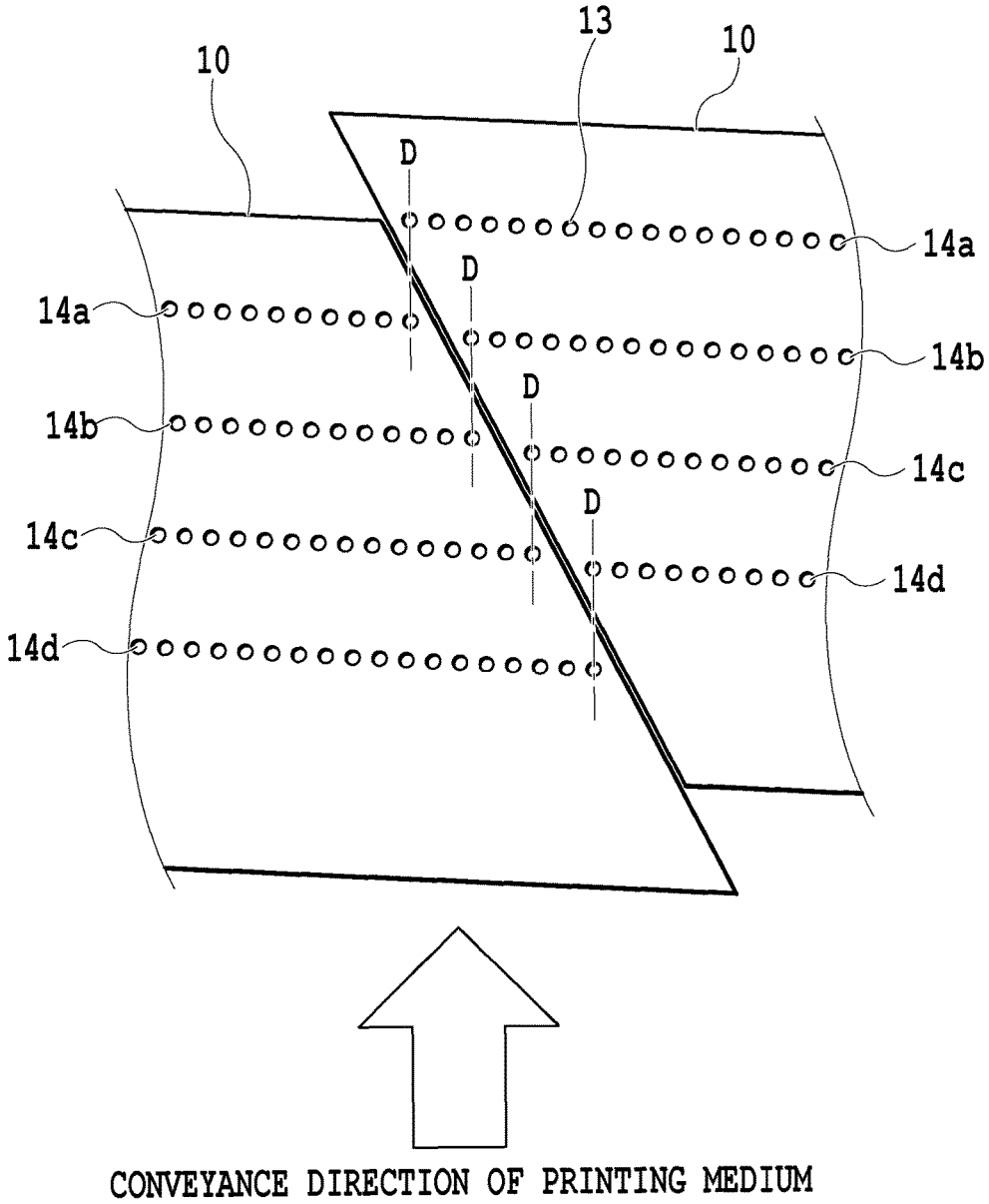
FIG. 13 is a plan view illustrating an adjacent part of the print element substrate in a partially enlarged manner.

FIG. 13 is a plan view illustrating adjacent portions of the print element substrates in two adjacent ejection modules in a partially enlarged manner. In this embodiment, the substantially parallelogram print element substrate is used. Each of the ejection port rows (14*a* to 14*d*) in which the ejection ports 13 are arrayed in each of the print element substrates 10 is arranged so as to be inclined by a certain angle with respect to the longitudinal direction of the print head 3. The ejection port rows in the adjacent portions of the print element substrates 10 are constituted so that at least one ejection port is overlapped in the conveyance direction of the printing medium. In FIG. 13, the two ejection ports on a line D are in an overlapped relationship with each other.

By means of this arrangement, even in a case where the position of the print element substrate 10 is slightly deviated from a predetermined position, black strips or voids in the print image can be made inconspicuous by driving control of the overlapping ejection port. Even in a case where the plurality of print element substrates 10 are arranged on a straight line (inline) instead of staggered arrangement, measures against the black stripes or voids in a connection portion between the print element substrates 10 can be taken while an increase in the length of the printing medium of the print head 10 in the conveyance direction is suppressed by the constitution in FIG. 13. In this embodiment, a main flat surface of the print element substrate is a parallelogram but this is not limiting, and even in a case where the print element substrate having a rectangle, trapezoid or other shapes is used, the constitution of the present invention can be suitably applied.

(Description of Circulation in Print Element Substrate)

Figure 14A:
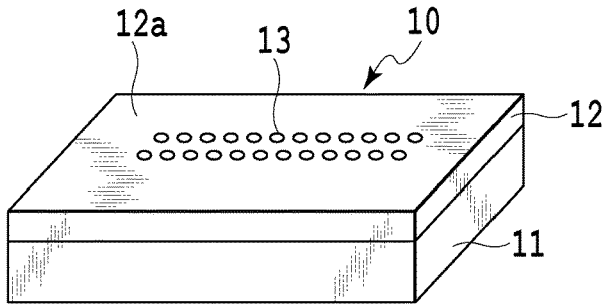
FIG. 14A is a view illustrating the print element substrate.
Figure 14B:
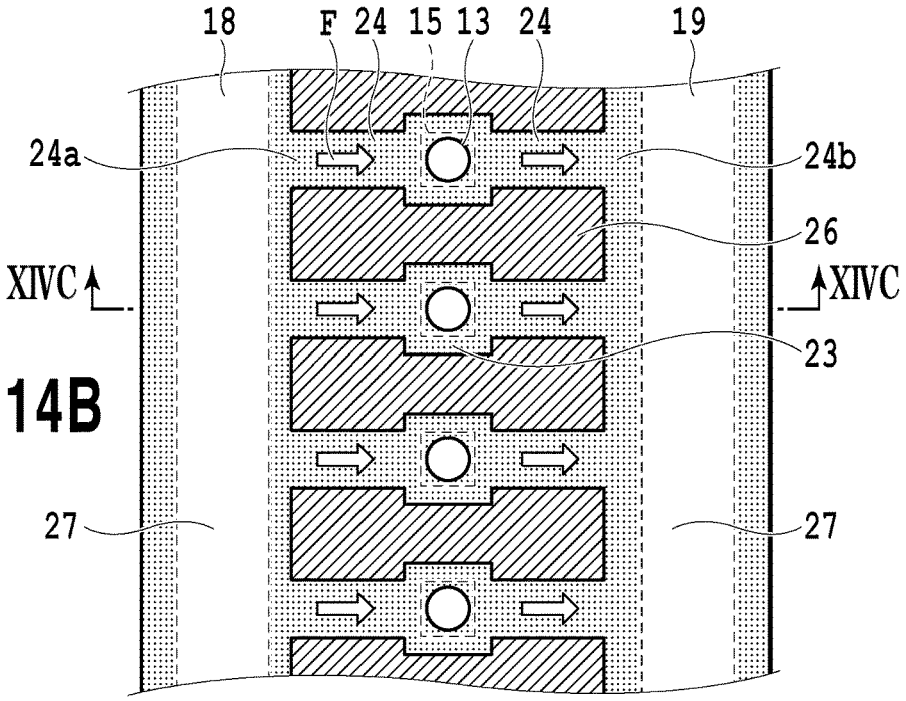
FIG. 14B is a view illustrating the print element substrate.
Figure 14C:
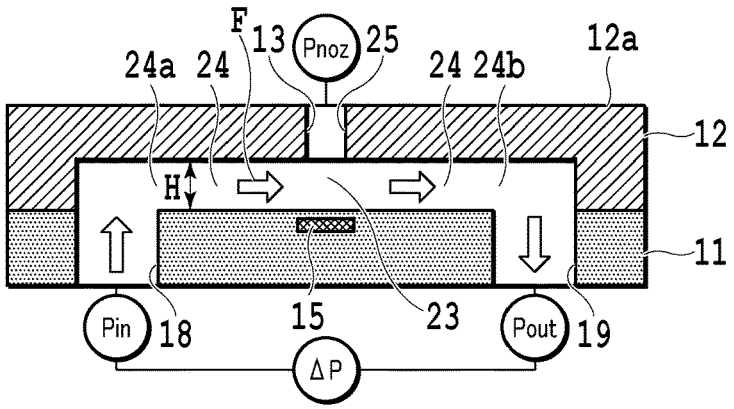
FIG. 14C is a view illustrating the print element substrate.

FIG. 14A is a perspective view illustrating the print element substrate 10 of the print head 3, FIG. 14B is a plan view illustrating a liquid channel inside the print element substrate, and FIG. 14C is a sectional view along XIVC-XIVC line in FIG. 14B. The print element substrate 10 has the substrate 11 and the ejection port forming member 12 faced with the substrate 11 and joined to the substrate 11. In the substrate 11, the print element 15 for ejecting the ink is provided. In the ejection port forming member 12, the ejection port 13 as the opening on the side faced with the printing medium is provided, and the ink is ejected to the printing medium 2 from this ejection port. A surface of the ejection port forming member 12 in which the ejection port 13 is opened (the surface faced with the printing medium) is called an ejection port forming surface (ejection port surface) 12*a* in some cases.

The ejection ports 13 are formed in plural, and the plurality of ejection ports 13 are arrayed linearly and form the ejection port row. Between the substrate 11 and the ejection port forming member 12, a liquid channel 24 faced with the print element 15 and the ejection port 13 is defined. In the liquid channel 24, a space where the print element 15 and the ejection port 13 are provided is the pressure chamber 23. The adjacent liquid channel 24 is partitioned by a wall 25.

A height H of the liquid channel 24 is preferably 25 μm or less. Here, the height H of the liquid channel 24 is defined by an interval between the substrate 11 measured in a direction perpendicular to a surface on which the print element 15 of the substrate 11 is provided and the ejection port forming member 12. In the case of the print head 3 with high density corresponding to 600 dpi or more, for example, the height H of the liquid channel 24 is preferably 3 μm or more. That is because a certain height should be ensured since a channel width is limited, by taking into consideration of refill characteristics and circulation characteristics.

The liquid supply path 18 and the liquid recovery path 19 are provided by penetrating from the front surface to the rear surface of the substrate 11. The liquid supply path 18 is connected to an inlet end portion 24*a* of the liquid channel 24 and supplies the ink to the liquid channel 24. The liquid recovery path 19 is connected to an outlet end portion 24*b* of the liquid channel 24 and recovers the ink not ejected from the ejection port 13 from the liquid channel 24. In the middle of the liquid channel 24 or preferably at a position by an equal distance from the inlet end portion 24*a* and the outlet end portion 24*b* of the liquid channel 24, the print element 15 and the ejection port 13 are formed. A pressure difference ΔP is provided between an inlet pressure Pin of the liquid supply path 18 and an outlet pressure Pout of the liquid recovery path 19. This pressure difference ΔP is set so that the inlet pressure Pin is larger than the outlet pressure Pout. As a result, a circulation flow F is generated in which the ink goes from the liquid supply path 18 to the liquid channel 24 and flows on the print element 15 and further goes through the liquid channel 24 to the liquid recovery path 19.

In this embodiment, the inlet pressure Pin and the outlet pressure Pout may be either of a positive pressure and a negative pressure as long as the inlet pressure Pin is larger than the outlet pressure Pout.

(Problem in Circulation Flow Velocity)

Figure 15A:
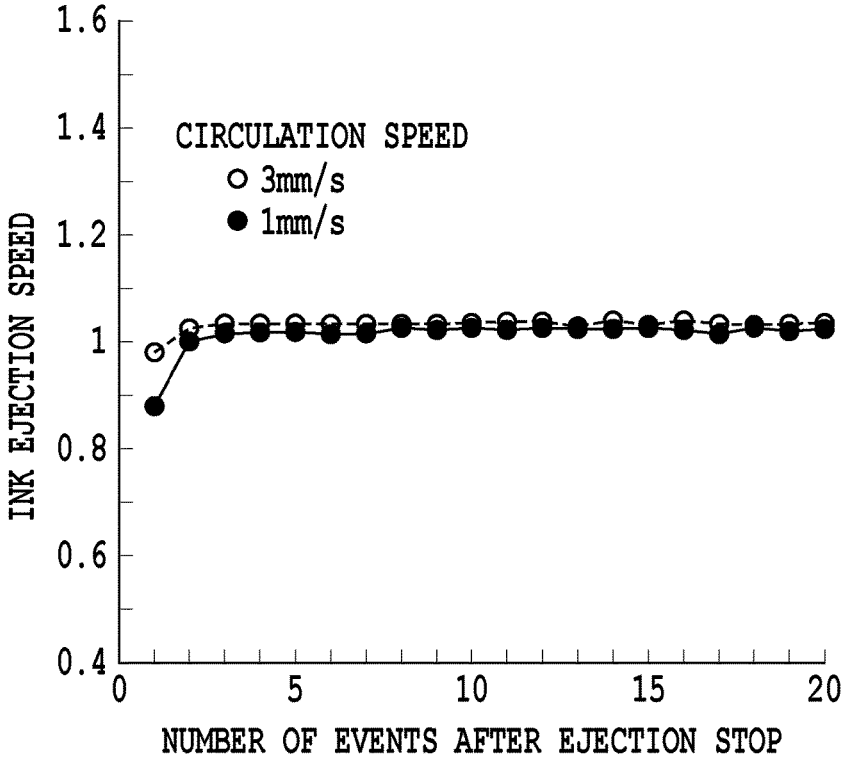
FIG. 15A is a view illustrating a graph of a number of ejections and a speed.
Figure 15B:
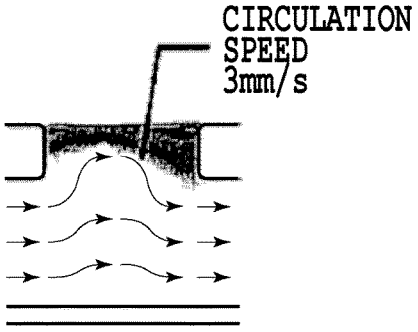
FIG. 15B is a view illustrating a degree of ink condensation in a pressure chamber.
Figure 15C:
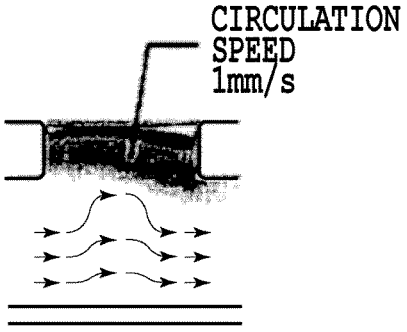
FIG. 15C is a view illustrating the degree of ink condensation in the pressure chamber.

FIG. 15A is a graph illustrating a relationship between the number of ejection hits and an ejection speed in a case where a circulation flow velocity of the circulation flow F is 1 mm/s and 3 mm/s. FIG. 15B is a view illustrating a degree of condensation of the ink inside the pressure chamber 23 in the case of the circulation flow velocity at 3 mm/s and FIG. 15C in the case of the circulation flow velocity at 1 mm/s. In order to check the degree of condensation of the ink inside the pressure chamber 23, droplets are ejected at a print head temperature of 40° C. from the print head 3, stopped for 1 second and then, the 20 droplets are continuously ejected. FIGS. 15B and 15C indicate that the darker the color is, the higher the viscosity becomes due to condensation of the ink.

In a case where the flow velocity of the circulation flow F is slow (see FIG. 15C), since an influence of an evaporation speed from the ejection port 13 is large, retention of the ink condensed by evaporation in the vicinity of the ejection port 13 cannot be prevented easily by the circulation flow F. As a result, after the stop of the ejection, the thickened ink can be easily retained in the vicinity of the ejection port 13, and an ejection speed of the first hit of the ink is lowered (see FIG. 15A).

On the other hand, in a case where the flow velocity of the circulation flow F is fast (see FIG. 15B), the influence of the evaporation speed from the ejection port 13 is relatively weakened, and after the stop of the ejection, the thickened ink cannot be retained easily in the vicinity of the ejection port 13. As a result, lowering of the ejection speed of the first hit of the ink is suppressed (see FIG. 15A). Therefore, the flow velocity of the circulation flow F is preferably sufficiently larger than the evaporation speed from the ejection port 13.

Figure 16:
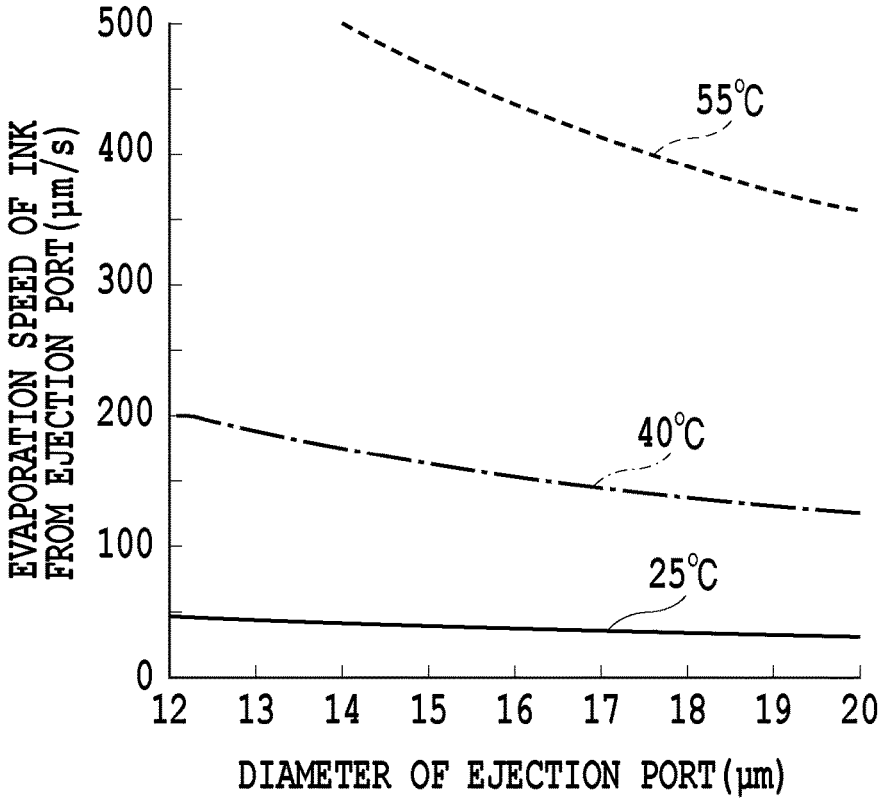
FIG. 16 is a graph illustrating a relationship between a diameter of an ejection port and an average evaporation speed from the ejection port.

FIG. 16 is a graph illustrating a relationship between a diameter of the ejection port 13 and an average evaporation speed from the ejection port 13 at various head temperatures. The evaporation speed is a speed of the ink evaporated from the ejection port 23 and is defined as a thickness of an ink layer evaporated per unit time. In more detail, the evaporation speed is equal to a thickness of an evaporation portion per unit time of the liquid inside a droplet ejection hole 25 penetrating the ejection port forming member 12. Moreover, in a case where the print head is at a high temperature, the evaporation speed in the ejection port 13 becomes extremely large.

In a case where the diameter of the ejection port 13 is 16 μm and the print head temperature is 40° C., it is known from FIG. 16 that the evaporation speed is approximately 150 μm/s. Therefore, by setting the flow velocity of the liquid (flow velocity of the circulation flow F) in the liquid channel 24 to 3 mm/s or more or 20 times or more of the evaporation speed at the ejection port 13, the retention in the vicinity of the ejection port 13 of the ink thickened by evaporation from the ejection port 13 can be suppressed.

(Problem in Circulation in Print Element Substrate)

As described above, by increasing the flow velocity of the circulation flow F, the thickened ink cannot be retained easily in the vicinity of the ejection port 13. On the other hand, the evaporated and thickened ink returns from the liquid channel 24 to the outlet end portion 24*b* along the flow of the circulation flow F, passes through the liquid recovery path 19 and flows into the common recovery channel 212 and is recovered in the main tank 1003 in the end. In a case of ejection at all times, since the evaporated and thickened ink is ejected, it does not return to the liquid recovery path 19. On the other hand, if duty of an image to be printed is low, substantially all the evaporated ink is returned to the liquid return path 19. That is, in a case where the image with low duty is continuously printed, the ink continues to be thickened.

Figure 17:
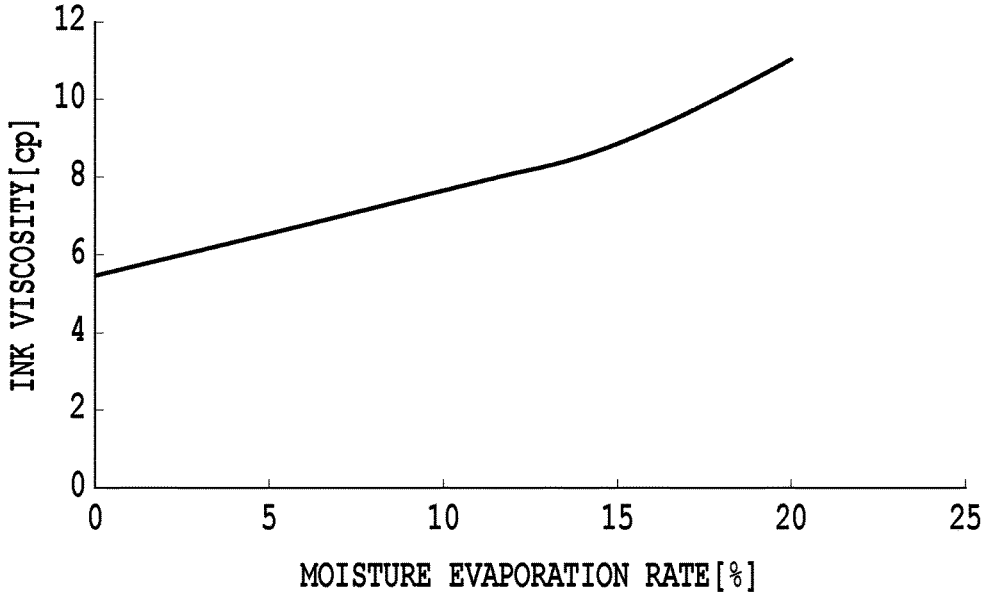
FIG. 17 is a graph illustrating ink viscosity at moisture evaporation.

FIG. 17 is a graph illustrating ink viscosity at moisture evaporation at an environmental temperature of 25° C. It is known that in a case where a moisture evaporation rate in the ink increases, the ink viscosity rises. On the other hand, there is an upper limit on the viscosity at which stable ejection can be made from the print head. In a case where the upper limit of the viscosity capable of stable ejection is 8 cp, continuous evaporation beyond 8 cp leads to unstable ejection or a non-ejection state. Thus, it is necessary that the evaporation amount of the ink in the circulation path is estimated and preliminary ejection or restoration processing should be executed so as not to exceed the upper limit of the viscosity capable of stable ejection. The estimation method of the moisture evaporation amount from the ink will be described below.

(Calculation of Evaporation Amount in Printing Operation)

Featured constitutions of the present invention will be described below.

Figure 18:
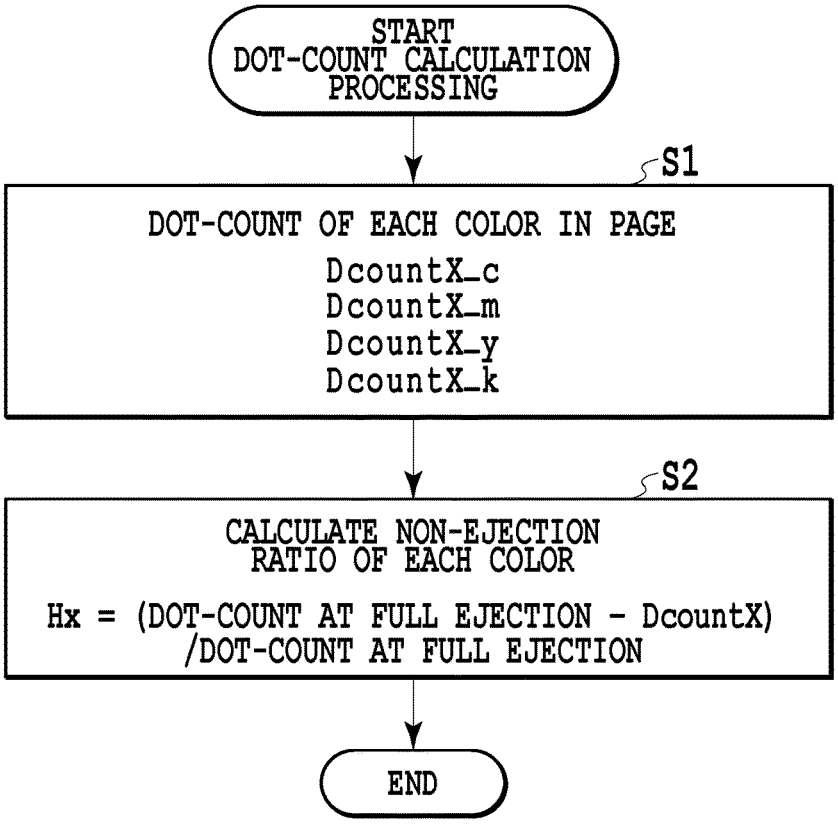
FIG. 18 is a flowchart illustrating dot-count calculation processing at reception of a printing instruction.

FIG. 18 is a flowchart illustrating dot-count calculation processing upon reception of a print command. In order to calculate evaporation of the moisture from the ink during the printing operation, first, the duty of the image to be printed is calculated. Hereinafter, the dot-count calculation processing will be described by using the flowchart in FIG. 18. In a case where the printing command is received, at Step S1, the number of ejection hits of each color in a page is counted (dot-count). Here, the dot-count is performed altogether for the 15 print element substrates 10 arrayed on a straight line in the longitudinal direction in the print head 3, but the dot-count may be performed for each of the print element substrates. After that, at Step S2, a non-ejection ratio $H_x$ of each color is calculated, and the processing is finished. Here, the non-ejection ratio $H_x$ is a value obtained by assuming that a case where each color makes full-ejection is 1, by subtracting an actual dot-count from the dot-count at the full ejection, and by dividing it by the dot-count in the full ejection.

TABLE 1

| Evaporation rate | Temperature control temperature [° C.] | | |
|---|---|---|---|
| [μg/sec] | Less than 25 | Less than 40 | 40 or more |
| Zx | 40 | 150 | 420 |

Figure 19:
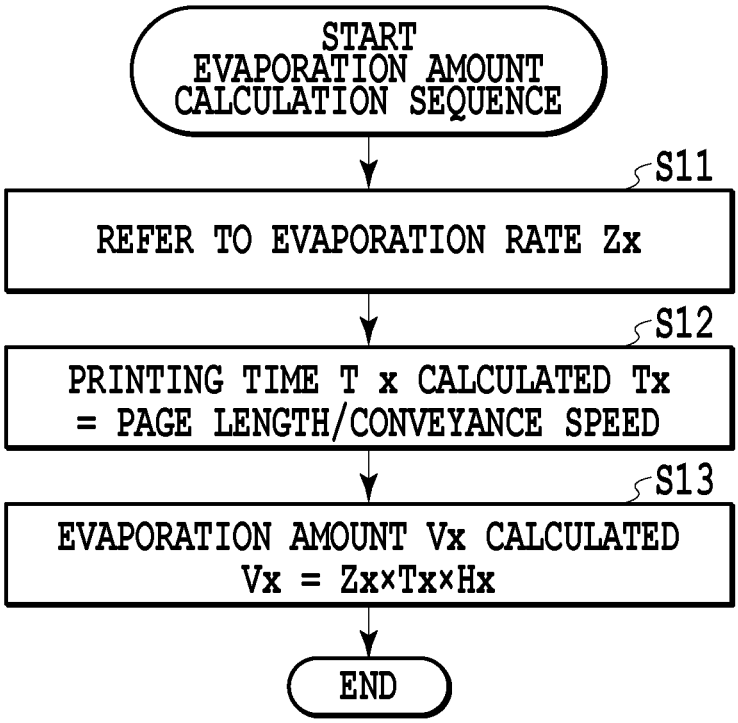
FIG. 19 is a flowchart illustrating evaporation amount calculation processing.

FIG. 19 is a flowchart illustrating evaporation amount calculation processing. In calculating an evaporation amount $V_x$ in a page, an evaporation rate from the ejection port 13 in performance of the circulation operation is measured in advance, and an evaporation rate $Z_x$ per second is stored in a memory. Hereinafter, the evaporation amount calculation processing will be described by using the flowchart in FIG. 19. In a case where the evaporation amount calculation sequence during the printing operation is started, at Step S11, temperature control temperature information during the printing operation is referred to, and the evaporation rate $Z_x$ at a print head temperature control temperature of 55° C., 40° C., and 25° C. is referred to. After that, at Step S12, printing time $T_x$ is calculated. The printing time $T_x$ required for printing 1 page is calculated by dividing a page length by conveyance speed. Then, at Step S13, the evaporation amount $V_x$ is calculated. Regarding the evaporation amount $V_x$, the evaporation amount $V_x$ in 1 page is calculated by multiplying the evaporation rate $Z_x$, the printing time $T_x$, and the non-ejection ratio $H_x$, and the processing is finished.

$$\text{Evaporation amount } V_x = \text{evaporation rate } Z_x \times \text{printing time } T_x \times \text{non-ejection ratio } Hx$$

By repeatedly executing the flowchart described above for each page, the evaporation amount $V_x$ from the print head during the printing operation can be calculated.

TABLE 2

| Evaporation rate | Environmental temperature [° C.] | | |
|---|---|---|---|
| [μg/min] | Less than 15 | Less than 25 | 25 or more |
| Zy | 1 | 2 | 5 |

(Calculation of Evaporation Amount During Non-Printing Operation)

During a non-printing operation, the ejection port 13 of the print head 3 is covered by the cap member. Thus, during the non-printing operation, as compared with the ejection port 13 during the printing operation, the evaporation per the same elapsed time is small. However, since the moisture in the ink is evaporated also from the print head 3 or an inside of the circulation path during the non-printing operation, in order to calculate the evaporation amount more accurately, the evaporation amount during the non-printing operation is also calculated. Thus, the evaporation rate in the non-printing operation is measured in advance, and an evaporation rate Zy per minute is stored in the memory as in Table 2.

Figure 20:
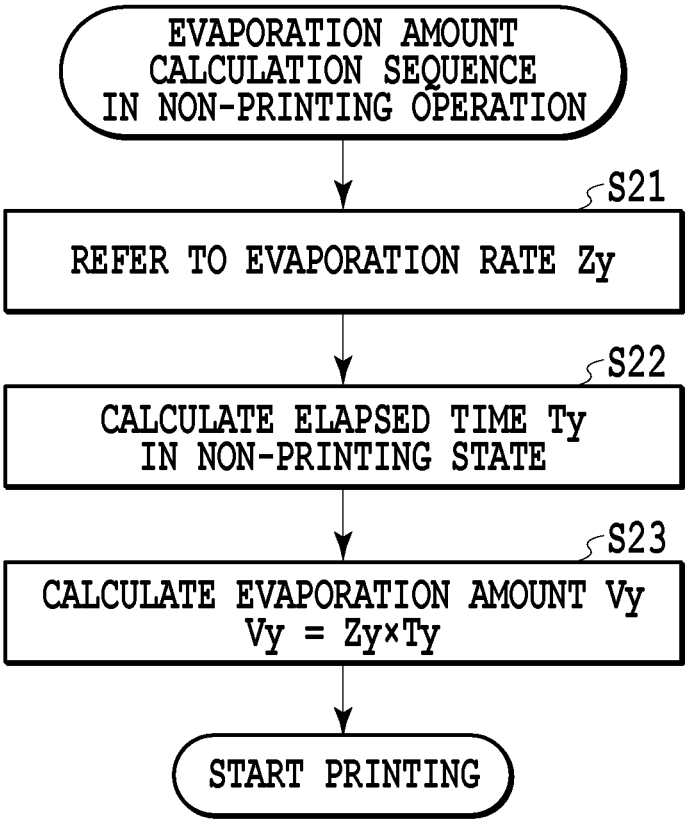
FIG. 20 is a flowchart illustrating the evaporation amount calculation processing during a non-printing operation.

In Table 2, the evaporation rate during the non-printing operation has a value smaller than that of the evaporation rate during the printing operation. Hereinafter, the evaporation amount calculation processing will be described by using a flowchart in FIG. 20. In a case where the evaporation amount calculation sequence in the non-printing operation is started, at Step S21, the temperature information during the non-printing operation is referred to, and the evaporation rate Zy is referred to. After that, at Step S22, elapsed time Ty in the non-printing operation state is calculated. Then, at Step S23, an evaporation amount Vy is calculated. The evaporation amount Vy is calculated by multiplying the evaporation rate Zy and the printing time Ty, and the processing is finished.

(Summation of Total Evaporation Amount)

The evaporation amount $V_x$ during the printing operation and the evaporation amount $V_y$ during the non-printing operation are calculated, and by adding them to a total evaporation amount V, a history of the evaporation amounts so far is calculated.

(Calculation of Consumed Ink Amount)

Figure 21:
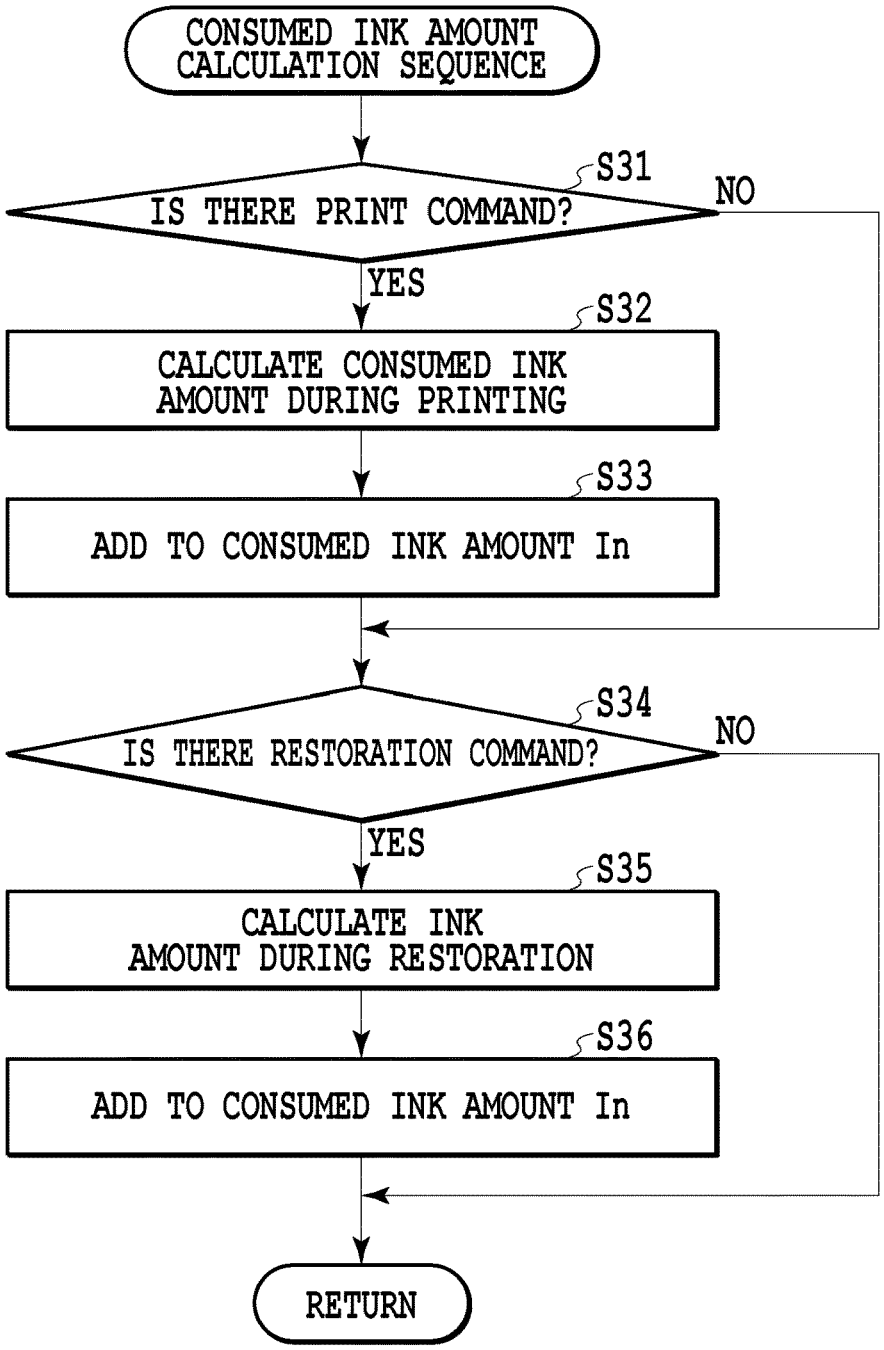
FIG. 21 is a flowchart of a consumed ink amount calculation processing.

FIG. 21 is a flowchart of consumed ink amount calculation processing. In order to calculate a degree of condensation of the ink in the circulation path, it is necessary to grasp a total ink amount in the circulation path, and thus, a consumed ink amount is calculated. Hereinafter, the consumed ink amount calculation processing will be described by using the flowchart in FIG. 21.

In a case where the consumed ink amount calculation processing is started, at Step S31, it is determined whether there is a printing command, and in a case where there is no printing command, the routine proceeds to Step S34 which will be described later. In a case where there is the printing command, the routine proceeds to Step S32, a printing usage amount obtained from the dot-count is referred to, and the consumed ink amount during printing is calculated. After the calculation, at Step S33, it is added to a consumed ink amount $I_n$.

Subsequently, at Step S34, it is determined whether there is a restoration command, and in a case where there is no restoration command, the processing is finished. In a case where there is a restoration command, the routine proceeds to Step S35, a restoration usage amount stored in the memory in advance is referred to, and it is added to the consumed ink amount $I_n$ at Step S36.

As described above, by adding the ink amount $I_n$ each time there is the printing command or the restoration command, the ink amount in the circulation path can be managed.

(Calculation of Pigment Density)

By calculating the evaporation amount V and by managing the ink amount $I_n$ in the circulation path, a solid portion density of the ink in the circulation path can be calculated. The solid portion of the ink here indicates a pigment or a resin contained in the ink, and hereinafter, their densities will be described as a pigment density.

Figure 22:
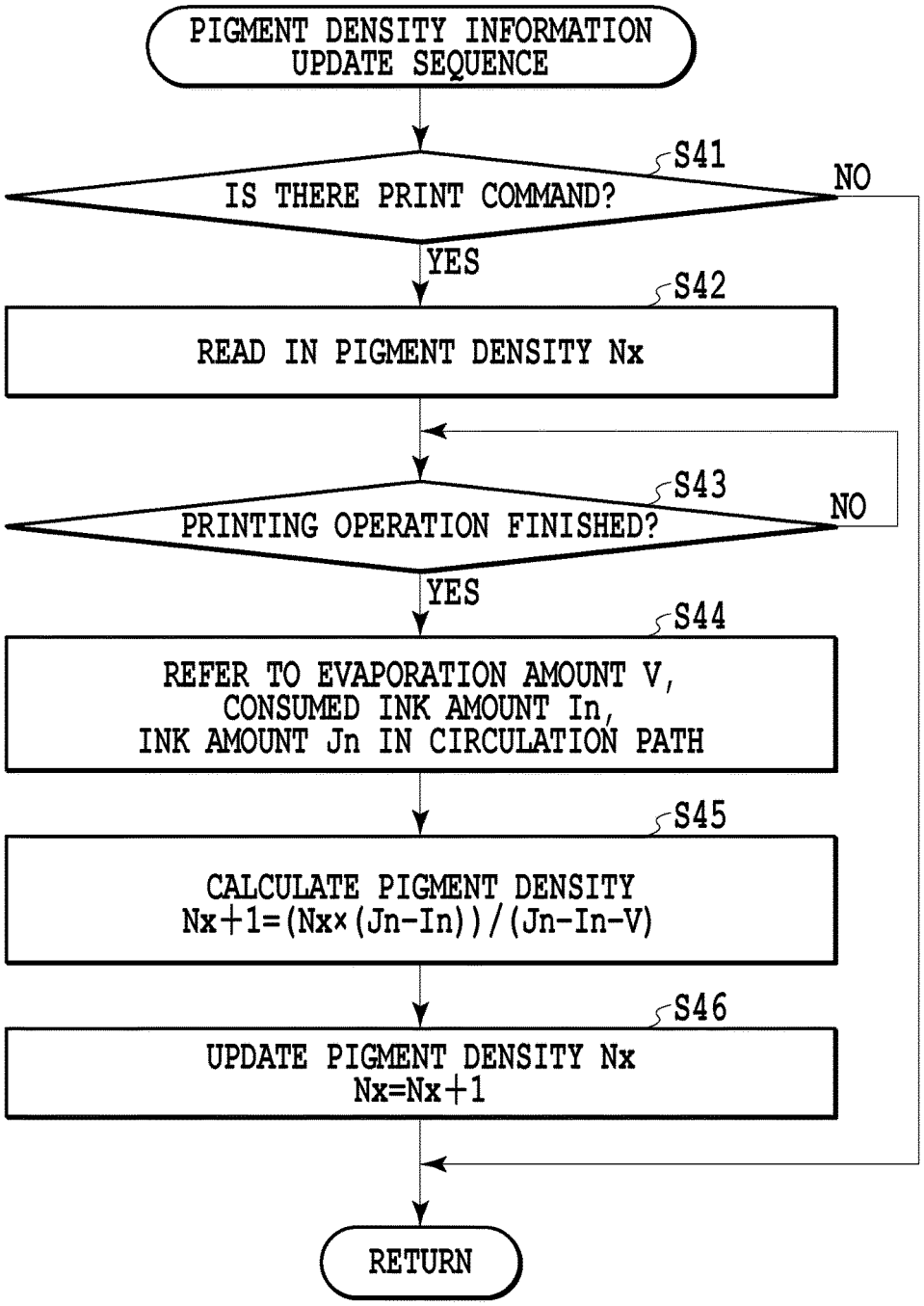
FIG. 22 is a flowchart illustrating pigment density information update processing.

FIG. 22 is a flowchart of pigment density calculation processing of the ink in the circulation path. Hereinafter, the pigment density calculation processing will be described by using the flowchart in FIG. 22. In a case where the pigment density calculation processing is started, at Step S41, it is determined whether there is the printing command. In a case where there is no printing command, the processing is finished. In a case where there is the printing command, the routine proceeds to Step S42, and a pigment density $N_x$ is read in.

An initial value $N_{ref}$ of the pigment density is set as in Table 3 below:

TABLE 3

| | Color | | | |
|---|---|---|---|---|
| | Bk | Cy | Ma | Ye |
| Nref | 0.08 | 0.06 | 0.06 | 0.06 |

After that, at Step S43, it is determined whether the printing operation has been finished, and in a case where the printing operation has not been finished, the routine returns and repeats the determination whether it is finished until it is finished. In a case where the printing operation has been finished, the routine proceeds to Step S44, and the evaporation amount V, the consumed ink amount $I_n$ after the printing is finished, and an ink amount $J_n$ in the circulation path as indicated in Table 4 below are referred to:

TABLE 4

| | Color | | | |
|---|---|---|---|---|
| | Bk | Cy | Ma | Ye |
| Jn [g] | 194 | 188 | 185 | 183 |

Then, at Step S45, a pigment density $N_{x+1}$ is calculated on the basis of the evaporation amount $V_x$, the consumed ink amount $I_n$, and the ink amount in the circulation path which were referred to.

Pigment density $N_{x+1}$=(pigment density $N_x$×(ink amount $J_n$ in path−consumed ink amount $In$))/(ink amount $J_n$ in path−consumed ink amount $I_n$−evaporation amount $V$)

After that, at Step S46, the current pigment density $N_x$ is updated, and the processing is finished.

By updating the pigment density $N_x$ as above, the pigment density of the ink in the circulation path can be managed.

(Condensation Determination and Restoration Control)

By managing the pigment density $N_x$ in the circulation path, in a case where the pigment density of the ink in the circulation path continues to rise and exceeds an upper limit value capable of stable ejection, restoration processing such as preliminary ejection or suction can be executed. Hereinafter, control of this restoration processing will be described.

TABLE 5

| | Color | | | |
|---|---|---|---|---|
| | Bk | Cy | Ma | Ye |
| Px | 0.089 | 0.067 | 0.067 | 0.067 |

Figure 23:
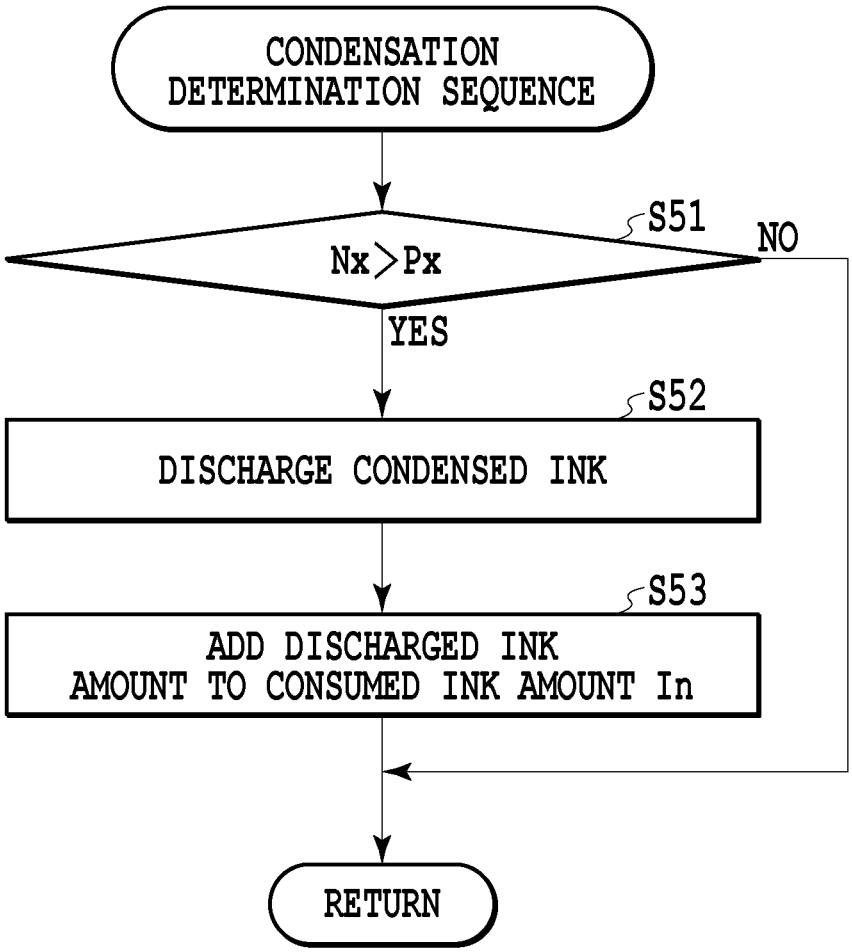
FIG. 23 is a flowchart illustrating density determination processing.

FIG. 23 is a flowchart illustrating condensation determination processing in the circulation path. Hereinafter, the condensation determination processing will be described by using the flowchart in FIG. 23. In a case where the condensation determination processing is started, at Step S51, it is determined whether the pigment density $N_x$ has exceeded a predetermined upper limit $P_x$ (predetermined density) or not. The predetermined upper limit value $P_x$ is stored for each color in advance as in Table 5. In a case where the pigment density $N_x$ has exceeded the predetermined upper limit $P_x$, the restoration control is executed at Step S52, and the condensed ink is discharged.

The restoration control here may be discharge by preliminary ejection or an ink discharging operation such as pressurization or suctioning. At that time, the higher the current pigment density $N_x$ is, the more the ink discharge amount may be increased in the restoration control. Unit for that may be an increase in the discharge amount by preliminary ejection or switching of the operation itself such as the preliminary ejection, pressurization, suctioning or the like. After that, at Step S53, the discharge amount is added to the consumed ink amount $I_n$.

(Pigment Density Calculation at Main Tank Replacement)

Figure 24:
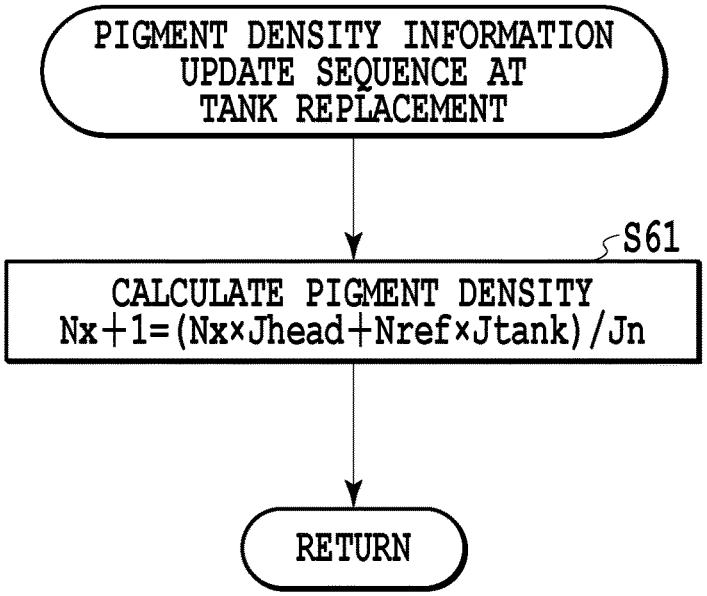
FIG. 24 is a flowchart illustrating the pigment density information update processing.

In a case where a remaining amount of the ink in the main tank in FIG. 2 gets smaller than a predetermined amount with elapse of use, the main tank is replaced with a new one. The pigment density of the ink contained in the new main tank is equal to the initial value $N_{ref}$. FIG. 24 is a flowchart of the pigment density calculation processing at main tank replacement. Hereinafter, the pigment density calculation processing will be described by using the flowchart in FIG. 24. After replacement of the main tank, at Step S61, the pigment density $N_{x+1}$ is calculated on the basis of an ink amount $J_{head}$ contained in the head and an ink amount $J_{tank}$ contained in the main tank in Table 6.

Pigment density $N_{x+1}$=(pigment density $N_x$×ink amount $J_{head}$ in the head+pigment density $N_{ref}$× ink amount $J_{tank}$ in the main tank)/ink amount $J_n$ in path

TABLE 6

| | Color | | | |
|---|---|---|---|---|
| | Bk | Cy | Ma | Ye |
| Jhead | 44 | 38 | 35 | 33 |
| Jtank | 150 | 150 | 150 | 150 |

Mixture of the ink at the pigment density initial value $N_{ref}$ contained in the main tank in the circulation path causes an action of returning to the pigment density initial value $N_{ref}$, and thickening of the ink in the circulation path is relaxed.

After that, as described above, the pigment density $N_x$ is updated while the evaporation amount $V_x$ and the consumed ink amount $I_n$ are calculated, and in a case where a predetermined threshold value is exceeded, the restoration control is executed.

As described above, by calculating the pigment density $N_x$ of the ink in the circulation path and by executing the restoration control on the basis of the pigment density $N_x$, the inkjet printing apparatus and its control method which can suppress defective ejection and wasteful ink consumption can be realized.

(Second Embodiment)

Hereinafter, a second embodiment of the present invention will be described by referring to the attached drawings. Since basic constitutions of this embodiment are similar to the first embodiment, only featured constitutions will be described below.

Figure 25:
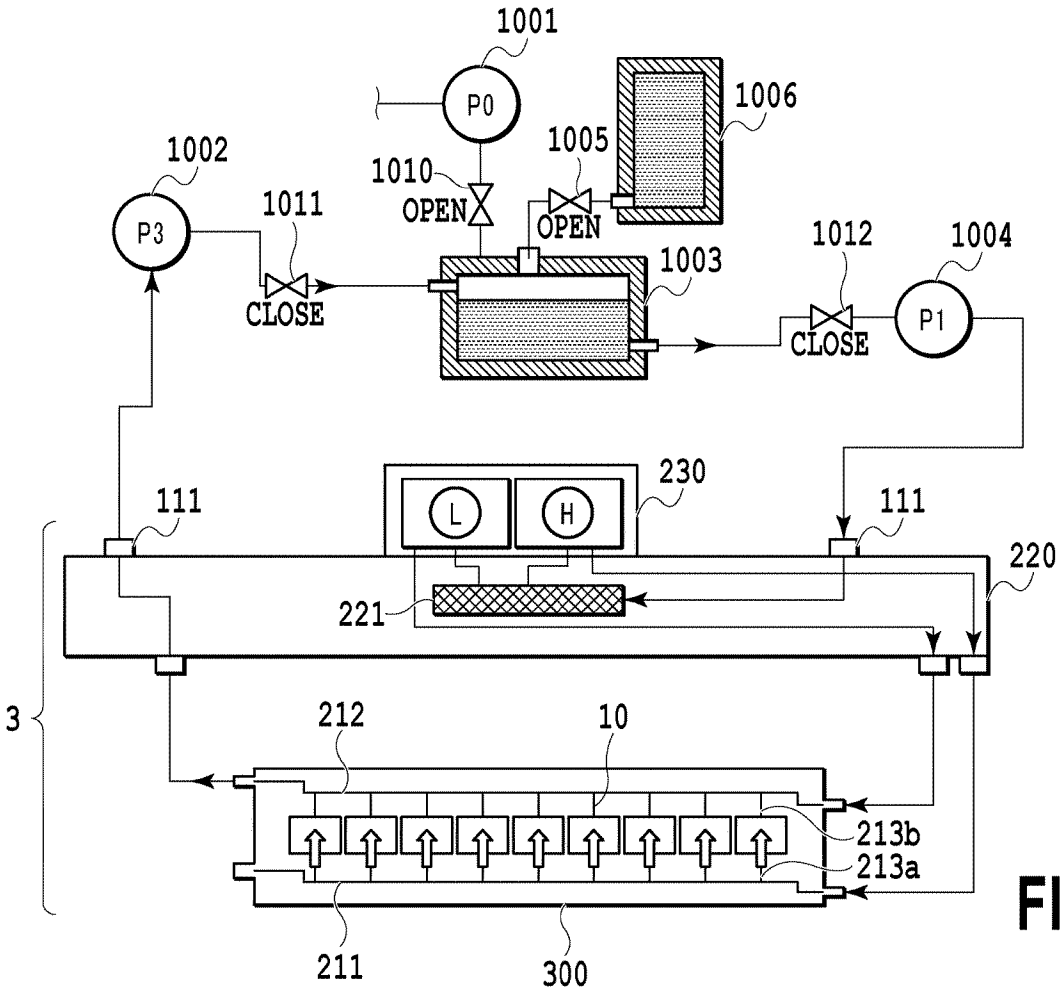
FIG. 25 is a schematic view illustrating a circulation path.
Figure 26:
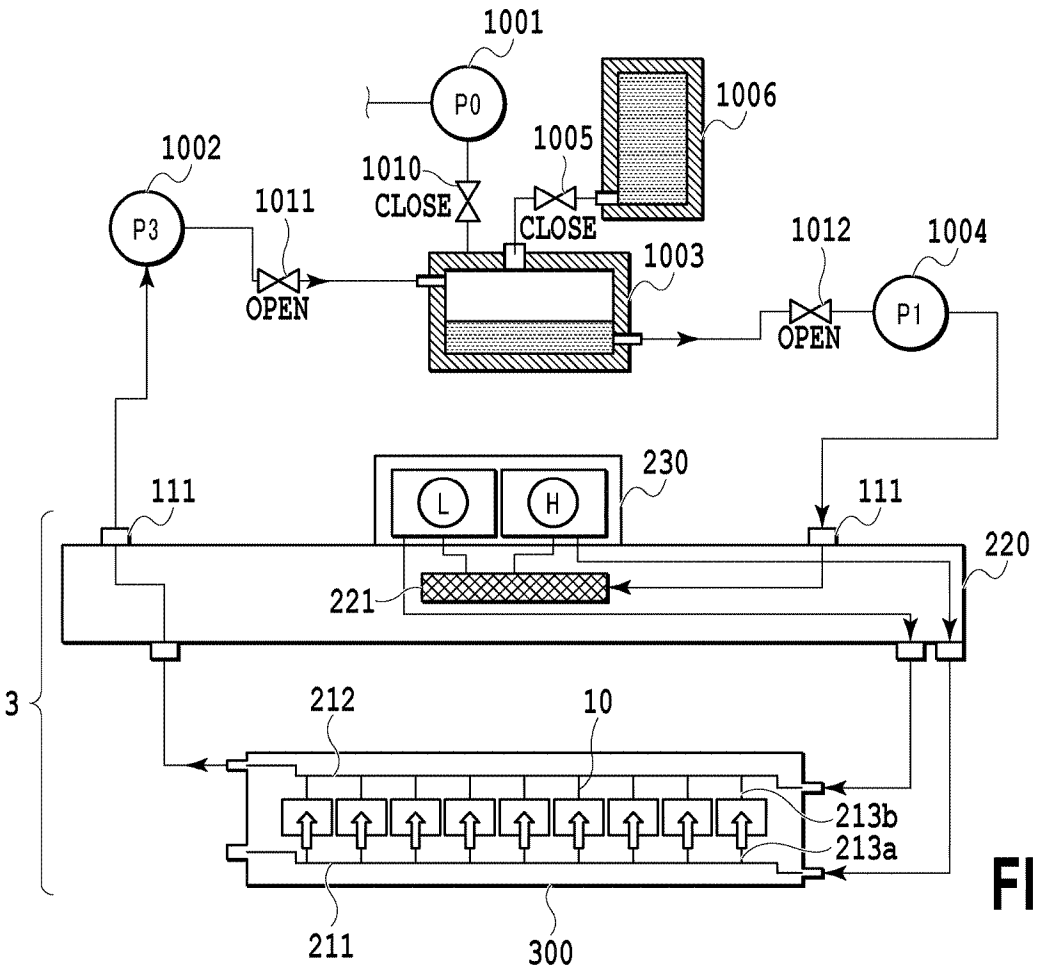
FIG. 26 is a schematic view illustrating the circulation path.

FIG. 25 is a schematic view illustrating a circulation path applied to the printing apparatus 1000 of this embodiment. In the circulation path of this embodiment, a tank used as the main tank in the first embodiment is changed to a buffer tank 1003, and a supply path is provided from a main tank 1006 to the buffer tank 1003 through a valve 1005. In a state where valves 1011 and 1012 are both closed, while a valve 1010 is opened, a pump 1001 connected to the buffer tank reduces a pressure in the buffer tank and brings the valve 1005 into an open state, the ink is supplied from the main tank to the buffer tank by a negative pressure generated in the buffer tank. On the other hand, as in FIG. 26, time other than ink supply, the valves 1005 and 1010 are in a closed state, and during the circulation operation in printing, the valves 1011 and 1012 are in an open state in which the circulation is performed. Moreover, in FIG. 25, only a path through which the ink in one color in the CMYK inks flows is illustrated for simplification of the description, but actually, the circulation paths in four colors are provided in the print head 3 and the printing apparatus body.

The ink supply operation for supplying the ink from the main tank 1006 to the buffer tank 1003 is performed in a case where the ink amount in the buffer tank 1003 gets smaller than the predetermined amount. Since a valve state is different between during the ink supply to the buffer tank and during the circulation operation in printing, the ink supply operation cannot be performed during printing. Thus, the ink supply operation is performed at arbitrary timing in a case where the printing command is not received (during non-printing).

(Calculation of Evaporation Amount)

Similarly to the processing described in the first embodiment, the evaporation amount $V_x$ during the printing operation and the evaporation amount $V_y$ during the non-printing operation are calculated and added to the total evaporation amount V, so that the history of the evaporation amounts so far is calculated.

(Calculation of Consumed Ink Amount)

Similarly to the processing described in the first embodiment, the consumed ink amount during printing and the consumed ink amount during restoration are calculated and added to the total consumed ink amount $I_n$ so that the history of the consumed ink amount so far is calculated.

(Pigment Density Calculation, Condensation Determination, and Restoration Control)

Figure 27:
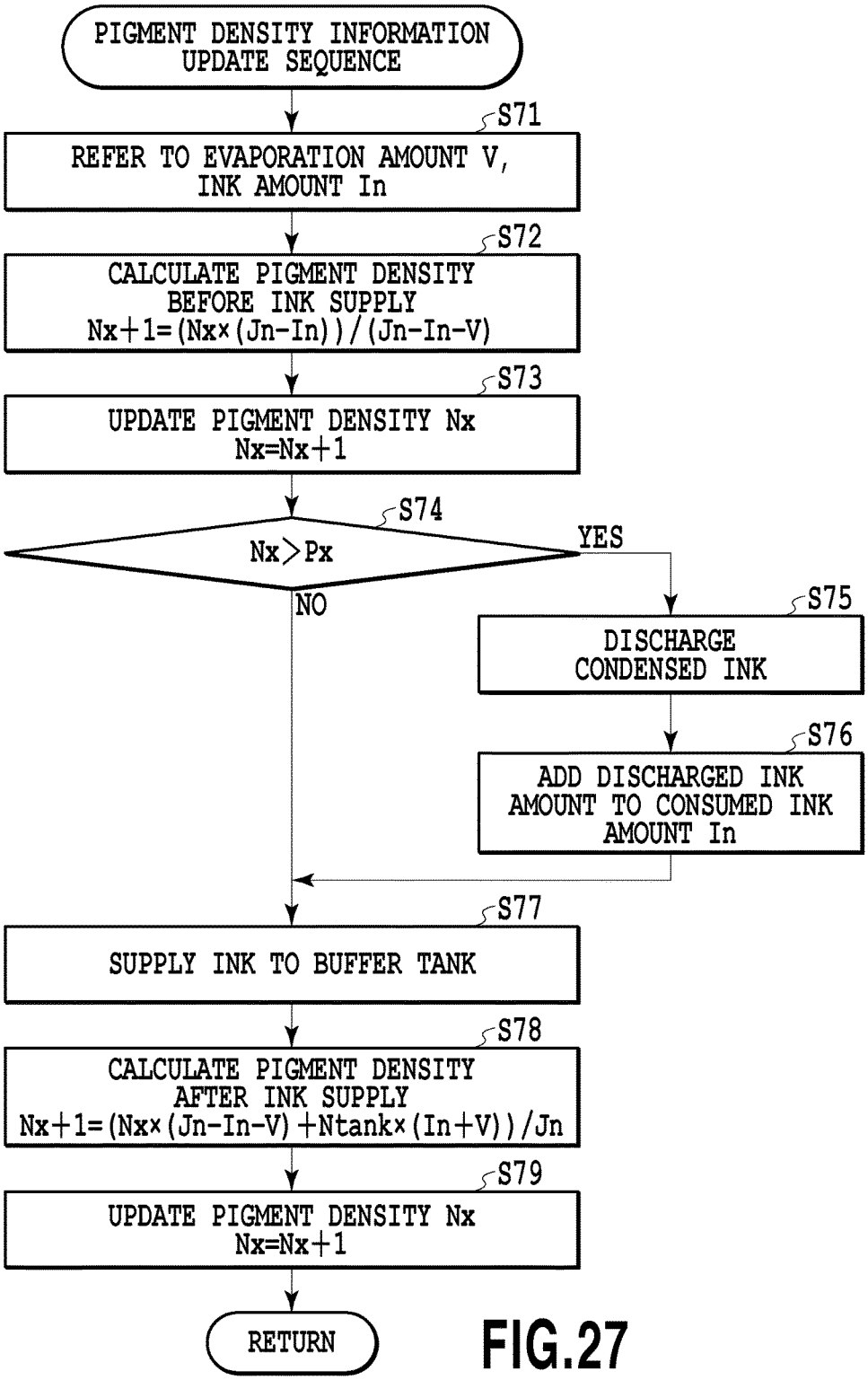
FIG. 27 is a flowchart illustrating pigment density calculation processing.

FIG. 27 is a flowchart illustrating the pigment density calculation processing in this embodiment. In this embodiment, the calculation of the pigment density is performed at timing that the ink is supplied from the main tank to the buffer tank. Hereinafter, the ink amount calculation processing will be described by using the flowchart in FIG. 27.

At Step S71, the evaporation amount V and the consumed ink amount $I_n$ so far are read in. At Step S72, the pigment density $N_{x+1}$ is calculated on the basis of the evaporation amount V, the consumed ink amount $I_n$, and the ink amount $J_n$ in the circulation path referred to.

Pigment density $N_{x+1}$=(pigment density $N_x$×(ink amount $J_n$ in the circulation path−consumed ink amount $I_n$))/(ink amount $J_n$ in the path−consumed ink amount $I_n$−evaporation amount $V$)

Subsequently, at Step S73, the pigment density $N_x$ is updated. At Step S74, it is determined whether the pigment density $N_x$ has exceeded the predetermined upper limit value Px (predetermined density). The predetermined upper limit value Px is stored for each color in advance as in the first embodiment. In a case where the pigment density $N_x$ has exceeded the upper limit value $P_x$, the restoration control is executed at Step S75, the condensed ink is discharged, and the discharged ink amount is added to the consumed ink amount $I_n$ at Step S76. After that, at Step S77, the ink supply operation is performed from the main tank to the buffer tank, and at Step S78, the pigment density information after the ink supply is updated. Here, the pigment density $N_{tank}$ of the ink supplied from the main tank is the same as the initial value $N_{ref}$ described in Table 3.

Pigment density $N_{x+1}$=(pigment density $N_x$×(ink amount $J_n$ in the circulation path−consumed ink amount $I_n$−evaporation amount $V$)+pigment density $N_{tank}$ of main tank×(consumed ink amount $I_n$+evaporation amount $V$))/ink amount $J_n$ in path After that, the pigment density $N_x$ is updated at Step S79.

By managing the evaporation amount and the consumed ink amount involved in the operations so far and by updating the pigment density $N_x$ on the basis of the ink amount with the initial density supplied from the main tank as above, the pigment density of the ink in the circulation path is managed, and the restoration control is executed on the basis of the pigment density $N_x$. As a result, the inkjet printing apparatus and its control method which can suppress defective ejection and wasteful ink consumption can be realized.

(Third Embodiment)

Hereinafter, a third embodiment of the present invention will be described by referring to the attached drawings. Since basic constitutions of this embodiment are similar to the second embodiment, only featured constitutions will be described below.

In the third embodiment, evaporation from the main tank is also considered, which is a different point. Independently of the evaporation amount and the consumed ink amount in the circulation path, an evaporation amount $V_{tank}$ from the main tank is calculated.

Figure 28:
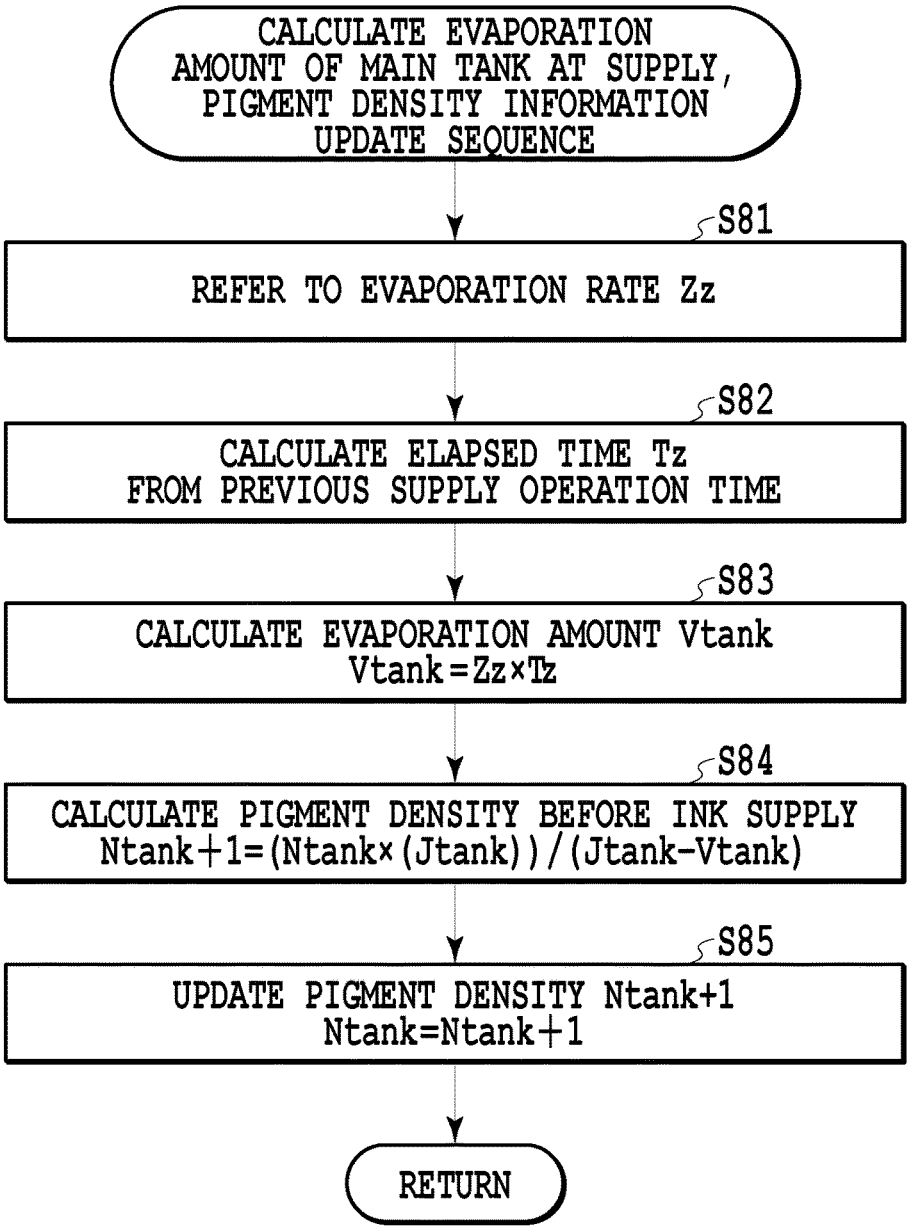
FIG. 28 is a flowchart illustrating the pigment density calculation processing.

The ink amount $J_{tank}$ in the main tank is updated by subtraction on the basis of the consumed ink amount $I_n$ and the evaporation amount V at each supply timing from the main tank to the buffer tank. On the other hand, the evaporation amount $V_{tank}$ from the main tank is also updated at each timing that the ink supply operation is performed. The evaporation amount calculation processing from the main tank will be described by using a flowchart in FIG. 28. As in Table 7, the evaporation rate during the non-printing operation is measured in advance, and an evaporation rate Zz per minute is stored in the memory. In a case where an ink supply sequence from the main tank to the buffer tank is started, at Step S81, the temperature information in the device is referred to, and the evaporation rate Zz is referred to. After that, at Step S82, elapsed time Tz from the previous supply operation time is calculated. Then, at Step S83, the evaporation amount $V_{tank}$ is calculated. The evaporation amount $V_{tank}$ is calculated by multiplying the evaporation rate Zz and the printing time Tz.

TABLE 7

| Evaporation rate | Environmental temperature [° C.] | | |
|---|---|---|---|
| [μg/min] | Less than 15 | Less than 25 | 25 or more |
| Zz | 2 | 8 | 20 |

Subsequently, at Step S84, the pigment density $N_{tank}$ of the main tank is calculated.

Pigment density $N_{tank+1}$=(pigment density $N_{tank}$×(ink amount $J_{tank}$ in the main tank)/(ink amount $J_{tank}$ in the main tank−evaporation amount $V_{tank}$)

Lastly, at Step 85, the pigment density $N_{tank}$ of the main tank is updated and completed.

The calculated pigment density $N_{tank}$ of the main tank is substituted in the formula of the pigment density update after the ink supply in Pigment density $N_{x+1}$=(pigment density $N_x$×(ink amount $J_n$ in the circulation path−consumed ink amount $I_n$−evaporation amount V)+pigment density $N_{tank}$ of main tank×(consumed ink amount $I_n$+evaporation amount V))/ink amount $J_n$ in path. The subsequent processing is the same as that in the second embodiment.

As described above, not only the evaporation amount in the circulation path and the consumed ink amount involved in the operations so far but also the evaporation amount in the main tank is managed, and by updating the pigment density $N_x$ on the basis of the ink amount supplied from the main tank, the pigment density of the ink in the circulation path is managed, and the restoration control is executed on the basis of the pigment density $N_x$. As a result, the inkjet printing apparatus and its control method which can suppress defective ejection and wasteful ink consumption can be realized.

(Fourth Embodiment)

Hereinafter, a fourth embodiment of the present invention will be described. Since basic constitutions of this embodiment are similar to the embodiments above, only featured constitutions will be described below.

In the consumed ink amount calculation processing in FIG. 21, the consumed ink amount during printing is calculated on the basis of the printing usage amount obtained from the dot counts. Here, the ejection amount per one session of ejection is different depending on the pigment density $N_x$ of the ink in the circulation path. Specifically, the higher the pigment density $N_x$ is, the higher the ink viscosity has been raised by moisture evaporation and thus, the ejection amount becomes smaller. Thus, in the fourth embodiment, in calculation of the consumed ink amount, as indicated in Table 8 and Table 9, the ejection amount per one session of ejection is changed and calculated in accordance with the pigment density $N_x$ at that point of time. As a result, the consumed ink amount calculation can be made more accurately.

TABLE 8

| Nx | Ejection amount of Bk [ng] |
|---|---|
| 0.08 or more and less than 0.083 | 5.7 |
| 0.083 or more and less than 0.086 | 5.5 |
| 0.086 or more and less than 0.089 | 5.3 |
| 0.089 or more | 5.1 |

TABLE 9

| Nx | Ejection amounts of Cy, Ma, and Ye [ng] |
|---|---|
| 0.06 or more and less than 0.0623 | 5.7 |
| 0.0623 or more and less than 0.0646 | 5.5 |
| 0.0646 or more and less than 0.0669 | 5.3 |
| 0.0669 or more | 5.1 |

(Fifth Embodiment)

Hereinafter, a fifth embodiment of the present invention will be described. Since basic constitutions of this embodiment are similar to the embodiments above, only featured constitutions will be described below.

In the evaporation amount calculation processing in FIG. 19, the evaporation amount during the printing operation is calculated on the basis of the evaporation rate $Z_x$ determined in Table 1. Here, the evaporation rate per one session of ejection is different depending on the pigment density $N_x$ of the ink in the circulation path. Specifically, the higher the pigment density $N_x$ is, the lower the moisture density falls due to moisture evaporation and thus, the evaporation rate becomes smaller. Thus, in the first to third embodiments, in calculation of the evaporation amount, as indicated in Table 10 and Table 11, the evaporation rate per one session of ejection is changed and calculated in accordance with the pigment density $N_x$ at that point of time. As a result, the evaporation amount calculation can be made more accurately.

TABLE 10

| | Zx | Evaporation rate of Bk [μg/sec] | | |
|---|---|---|---|---|
| | Temperature control temperature[° C.] | Less than 25 | Less than 40 | 40 or more |
| Nx | 0.08 or more and less than 0.083 | 40 | 150 | 420 |
| | 0.083 or more and less than 0.086 | 40 | 151 | 421 |
| | 0.086 or more and less than 0.089 | 40 | 151 | 423 |
| | 0.089 or more | 40 | 152 | 424 |

TABLE 11

| | Zx | Evaporation rate of Col [μg/sec] | | |
|---|---|---|---|---|
| | Temperature control temperature[° C.] | Less than 25 | Less than 40 | 40 or more |
| Nx | 0.06 or more and less than 0.0623 | 40 | 150 | 420 |
| | 0.0623 or more and less than 0.0646 | 40 | 151 | 421 |
| | 0.0646 or more and less than 0.0669 | 40 | 151 | 423 |
| | 0.0669 or more | 40 | 152 | 424 |

(Ink Discharge at Head Replacement, Body Transport)

A life is set to the print head 3, and it is replaced at timing determined in advance such as after printing of a predetermined number of sheets or after elapse of predetermined time in some cases. Moreover, after start of use of the printing apparatus 1, a user transports the printing apparatus 1 in some cases (secondary transport). In these cases, the head replacement or transport processing is usually executed in a state where the ink is filled in the printing apparatus 1. On the other hand, in a case where the pigment density $N_x$ of the ink in the circulation path is high, the apparatus is used in a state where the pigment density $N_x$ of the ink in the circulation path is still high after the replacement to a new head or use is resumed at a transport destination. Thus, as indicated in Table 12 and Table 13, switching is made between holding of the ink in the circulation path as it is in the printing apparatus 1 or discharge processing of the ink in the circulation path in accordance with the pigment density $N_x$ of the ink in the circulation path at timing before the head replacement or before transport of the printing apparatus. As a result, presence of ink discharge is determined at the head replacement or transport processing, and switching can be made between reset of the pigment density of the ink in the circulation path after that to an initial value or continuation of the use as it is.

TABLE 12

| | Nx (Bk) | |
|---|---|---|
| | Less than 0.089 | 0.089 or more |
| Processing contents | Holding of ink in printing apparatus | Discharge of ink in printing apparatus |

TABLE 13

| | Nx (Col) | |
|---|---|---|
| | Less than 0.0669 | 0.0669 or more |
| Processing contents | Holding of ink in printing apparatus | Discharge of ink in printing apparatus |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-129086, filed Jun. 29, 2016, and No. 2017-094289, filed May 10, 2017, which are hereby incorporated by reference wherein in their entirety.

What is claimed is:

1. An inkjet printing apparatus comprising:

(a) a print head configured to print an image by ejecting an ink from an ejection port;

(b) a tank configured to store the ink supplied to the print head;

(c) a first path for supplying ink from the tank to the print head;

(d) a second path for collecting ink from the print head and returning the collected ink to the tank;

(e) a circulation path including the tank, the first path, the print head, and the second path, the circulation path being configured to circulate the ink between the print head and the tank, (f) a discharging unit configured to perform a discharging operation for discharging the ink in the circulation path;

(g) an evaporation amount calculating unit configured to calculate an evaporation amount of the ink;

(h) a calculating unit configured to calculate a value relating to ink density in the circulation path on the basis of (i) an amount of ink in the circulation path and (ii) the evaporation amount of the ink; and (i) a control unit configured to cause the discharging unit to perform the discharging operation based on the value relating to the ink density calculated by the calculating unit.

2. The inkjet printing apparatus according to claim 1, wherein, in a case where the value relating to the ink density calculated by the calculating unit is higher than a predetermined value, the control unit causes the discharging unit to perform the discharging operation.

3. The inkjet printing apparatus according to claim 1, further comprising an ink tank configured to store the ink supplied to the tank, wherein, in a case where the ink amount in the tank becomes smaller than a predetermined amount, the control unit supplies the ink from the ink tank to the tank.

4. The inkjet printing apparatus according to claim 1, wherein the evaporation amount calculating unit calculates an evaporation amount of the ink in a non-printing operation.

5. The inkjet printing apparatus according to claim 1, further comprising a consumed ink amount calculating unit configured to calculate a consumed ink amount.

6. The inkjet printing apparatus according to claim 1, wherein the print head has an element configured (i) to generate heat to boil the ink in the print head and (ii) to eject the ink from the ejection port when the ink is boiled by the element, and wherein the element generates heat in response to an ejection control signal.

7. A control method of an inkjet printing apparatus that includes (a) a print head configured to print an image by ejecting an ink from an ejection port, (b) a tank configured to store the ink supplied to the print head, and (c) a circulation path that includes (i) the tank, (ii) a first path for supplying ink from the tank to the print head, (iii) the print head, and (iv) a second path for collecting ink from the print head and returning the collected ink to the tank, the circulation path being configured to circulate the ink between the print head and the tank, the method comprising:

(A) an evaporation amount calculating step of calculating an evaporation amount of the ink;

(B) a calculating step of calculating a value relating to ink density in the circulation path on the basis of (i) an amount of ink in the circulation path and (ii) the evaporation amount of the ink; and (C) a discharging control step of discharging the ink in the circulation path on the basis of the value relating to the ink density calculated by the calculating step.

* * * * *